US008123215B2

(12) United States Patent
Kanda

(10) Patent No.: US 8,123,215 B2
(45) Date of Patent: Feb. 28, 2012

(54) SHEET ALIGNING APPARATUS AND IMAGE FORMING SYSTEM

(75) Inventor: Takanori Kanda, Hino (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 253 days.

(21) Appl. No.: 12/463,870

(22) Filed: May 11, 2009

(65) Prior Publication Data

US 2009/0283954 A1 Nov. 19, 2009

(30) Foreign Application Priority Data

May 14, 2008 (JP) ..... 2008-126829

(51) Int. Cl.
*B65H 9/04* (2006.01)

(52) U.S. Cl. ..... 271/244; 271/238; 271/902; 270/58.27

(58) Field of Classification Search ..... 271/233, 271/238, 241, 244, 902; 270/58.12, 58.17, 270/58.27, 59
See application file for complete search history.

(56) References Cited

U.S. PATENT DOCUMENTS 7,613,422 B2 * 11/2009 Shida et al. ..... 399/407
7,862,016 B2 * 1/2011 Takemoto et al. ..... 270/37
7,883,086 B2 * 2/2011 Kamiya ..... 271/220
2006/0120784 A1 * 6/2006 Iida et al. ..... 399/407
2007/0102861 A1 * 5/2007 Shida et al. ..... 270/59
2008/0099974 A1 * 5/2008 Nomura et al. ..... 270/58.12
2008/0237964 A1 * 10/2008 Kiriyama ..... 270/58.27
2008/0258373 A1 * 10/2008 Wakabayashi et al. .... 270/58.17
2008/0265484 A1 * 10/2008 Fukasawa et al. ..... 270/58.12
2008/0284092 A1 * 11/2008 Suzuki et al. ..... 271/244

FOREIGN PATENT DOCUMENTS

JP 2007-137536 6/2007

OTHER PUBLICATIONS

European Search Report dated Aug. 30, 2010.

* cited by examiner

*Primary Examiner* — Jeremy R Severson
(74) *Attorney, Agent, or Firm* — Finnegan, Henderson, Farabow, Garrett & Dunner, L.L.P.

(57) ABSTRACT

In a sheet aligning apparatus, a sheet is conveyed from a conveying-in path into a sheet storing section through an open end portion and the leading end of the sheet comes in with a stop member. Thereafter, when a shifting section shifts the stop member from an initial position to a first position, the sheet is shifted inversely together with the stop member and the back end of the sheet proceeds as the inversed leading end from the open end portion to a conveying-out path so that a succeeding sheet is allowed to be conveyed from the conveying-in path into the open end portion. When the sheet is shifted inversely, a shift regulating section regulates the shift of the sheet in such a way that the back end of the sheet is prevented from proceeding more than a predetermined distance due to the inertia of the shift.

9 Claims, 15 Drawing Sheets

SHEET ALIGNING APPARATUS AND IMAGE FORMING SYSTEM

This application is based on Japanese Patent Application No. 2008-126829 filed on May 14, 2008 in Japanese Patent Office, the entire content of which is hereby incorporated by reference.

BACKGROUND OF THE INVENTION

The present invention relates to a sheet aligning apparatus and an image forming system. Especially, the present invention relates to a sheet aligning apparatus which makes it possible to perform a sheet post processing efficiently and an image forming system equipped with the sheet aligning apparatus.

Conventionally, as an image forming system, a well known system is equipped with an image forming apparatus, such as a printer, a copying machine, and a composite machine, and a post processing apparatus which performs a post processing, such as a punching process, a folding process, a binding process, and so forth for to sheets on which images have been formed by the image forming apparatus.

A post processing section as a structural section of an image forming system is generally an apparatus which performs a shifting process, a punching process, a binding process, a folding process, a pasting bookbinding process, etc. for sheets on which images have been formed.

Moreover, for such a punching process section, a binding process section, a folding process section, and a pasting bookbinding process section, an aligning process section for aligning sheets as a pretreatment section of those processes is provided.

Generally, this aligning process section is provided in a post processing section, has a structure which comprises an inclined intermediate stacker and a movable regulating member provided in the both sides or one side of the intermediate stacker, and conducts an aligning process for sheets on a conveyance path to convey sheets to a binding process section or a folding process section. Namely, the aligning process section drops and slides sheets into the inclined intermediate stacker to align sheets in the conveying direction. In the stage where the preset number of sheets has been accumulated in the intermediate stacker, the aligning process section stops feeding sheets to the intermediate stacker, reciprocates a movable regulating member, and aligns sheets in the widthwise direction of the conveyance path. Thereafter, a post processing, such as a punching process, a binding process, a folding process, and a pasting bookbinding process, is performed for the aligned sheets.

Furthermore, in conventional post processing apparatuses, there is a post processing apparatus in which a sheet reversing conveying section called an intermediate conveyance unit and a sheet width regulating member to align sheets widthwise are provided before post processing. However, there is no post processing apparatus equipped with a sheet aligning section to align sheets in the sheet conveying direction in the sheet reversing conveying section. The conventional post processing apparatuses conduct sheet aligning just before performing post processing, such as a punching process, a binding process, and a folding process by regulating the leading end or back end of sheets in respective post process.

Therefore, since it is necessary to take time to align sheets in each post process, there is a problem that a sheet processing speed becomes low.

Moreover, conventional aligning process sections need to stop conveying a succeeding sheet during conducting post processing for preceding sheets. Therefore, since the sheet processing speed becomes low more, the conventional aligning process sections are not suited for the high speed performance of an image forming apparatus. As a result, there is a problem that the high speed performance of an image forming apparatus is not fully exhibited.

Furthermore, when performing an aligning process, since conveyance stop control is executed, the control method becomes complicated, and stability tends to be failed. Therefore, there is further a problem that a conveyance trouble such as a jam tends to occur easily.

In order to solve these problems, for example, Japanese Patent Unexamined Publication No. 2007-137536 discloses a technique to provide a sheet aligning apparatus in an intermediate conveyance unit so that a plurality of sheets are conveyed simultaneously and an aligning process for succeeding sheets can be performed at high speed even if preceding sheets are subjected to a post processing.

According to the technique disclosed by the above publication, a sheet storage section to store a plurality of inversed sheets is provided between an image forming apparatus and a post processing apparatus, the sheet storage section receives sheets by a stop member capable of shifting upward and downward, and conducts sorting and aligning succeeding sheets in the conveying direction by shifting the stop member.

FIG. 16 is a front side cross sectional view of an intermediate conveyance unit B which has the sheet storage section equipped with the sheet aligning device disclosed by the above publication.

Hereafter, the structure and operations of the sheet aligning apparatus by the use of the above intermediate conveyance unit B are explained as an conventional example with reference to FIG. 16.

In FIG. 16, the intermediate conveyance unit B is provided at the downstream side of an image forming apparatus main body A in the sheet conveying direction, and a post processing apparatus FS is arranged further at the downstream side of the intermediate conveyance unit B.

A sheet conveyance section of the intermediate conveyance unit B is constituted by a sheet conveying-in section (first conveying section) 11, a sheet storage section (second conveying section) 12, a sheet conveying-out section (third conveying section) 13, and a sheet reversing section (fourth conveying section) 14.

The sheet conveying-in section 11 is equipped with a sheet conveying-in conveyance path r11 which comprises conveying rollers R1 and R2 and a guide plate 111. In the sheet conveying-in section 11, sheets S discharged from a discharging section 5E of the image forming apparatus main body A are conveyed sequentially.

The sheet storage section 12 is equipped with two guide plates 121, a widthwise aligning section 122, a stop member 123, a lengthwise aligning member 124, a conveying-in drive roller R3, a conveying-out drive roller R4, and a sheet storage conveyance path r12.

The two guide plates 121 are arranged in parallel, and form the sheet storage conveyance path r12 therebetween.

The sheet storage conveyance path r12 is a conveying path for conveying in or conveying out sheets S for the sheet storage section 12.

Plural sheets S conveyed from the sheet conveying-in section 11 into the sheet storage section 12 are arranged on the stacked condition and stored in the sheet storage section 12. Then, the plural sheets S are aligned in the sheet conveying direction between the stop member 123 and the lengthwise aligning member 124, further aligned in the sheet width direction by the widthwise aligning member 122, and thereafter discharged upward.

The stop member 123 being stopping and waiting at an initial stop position P0 is shifted upward by a motor (not illustrated in the drawing) along the sheet storage conveyance path r12, and stopped at the first stop position P1 or the second stop position P2.

Namely, a preceding sheet S1 is conveyed in the sheet conveying-in direction from the sheet conveying-in section 11 into the sheet storage section 12, and the leading end of a preceding sheet S1 in the sheet conveying-in direction comes in contact with a stopping surface 123A of the stop member 123. Thereafter, the stop member 123 is shifted upward in the sheet conveying-out direction by a stop member shifting section (the above motor) so that the stop member 123 conveys the preceding sheet S1 inversely in the sheet conveying-out direction. Then, the back end of the preceding sheet becomes the inversed leading end of the preceding sheet in the sheet conveying-out direction by the inversely conveying, and when the inversed leading end (the back end) of the preceding sheet arrives at a middle point between the conveying-in drive roller R3 and the conveying-out drive roller R4, the stop member 123 is stopped at the first stop position P1. Hereafter, in order to make the word "the leading end in the conveying-out direction" distinguishable from the word "the leading end in the conveying-in direction", "the leading end in the conveying-out direction" is expressed as "the inversed leading end in the conveying-out direction" or "the inversed leading end".

Here, the first stop position P1 is a position to stop the stop member when the inversed leading end of the preceding sheet has passed over the lower end position of a conveyance path switching member G1 and reached a region before a nip section of a conveying-out drive roller R4, whereby the interruption of a succeeding sheet can be avoided.

After the stop member 123 conveying the preceding sheet S1 has stopped at the first stop position P1, a succeeding sheet S2 is conveyed in towards the sheet storage section 12 by the rotation of the conveying-in drive roller R3. Since the inversed leading end of the preceding sheet S1 is positioned upward from the leading end of the succeeding sheet S2 by shifting the stop member 123 to the first stop position P1, the inversed leading end of the preceding sheet S1 does not interfere with the leading end of the succeeding sheet S2.

Then, with the conveying-in of the succeeding sheet S2 into the sheet storage section 12, the stop member 123 is driven by the stop member shifting section, and returns to the initial stop position P0, and the preceding sheet S1 and the succeeding sheet are stored on the stacked condition in the sheet storage section 12.

When the predetermined number of sheets S are stored in the sheet storage section 12, the stop member 123 is driven again by the stop member shifting section so as to be shifted upward, and is stopped at the second stop position P2 located at the downstream side of the first stop position P1 in the sheet conveying-out direction.

Here, the second stop position P2 is a position to stop the stop member 124 when the reversed leading end of the plural sheets S shifted together with the stop member 123 arrives at a position where the reversed leading end of the plural sheets S come in contact with the lengthwise aligning member 124 in such a way that the plural sheets S are aligned in the sheet conveying direction.

The conveyance path switching member G1 is arranged at the upper portion of the sheet storage section 12 and switches a conveying-in path to convey a sheet S into the sheet storage section 12 and a conveying-out path to covey a sheet S from the sheet storage section 12.

The plural sheets S aligned by the lengthwise aligning member 124 are pinched between the conveying-out drive roller R4 and the conveying-out follower roller R11 by the switch operation of the conveyance path switching member G1, and are conveyed to the sheet conveying-out section 13.

The sheet conveying-out section 13 is equipped with a sheet conveying path r13 including an intermediate conveying roller R5, a sheet ejecting roller R6, and a guide plate 131. In the sheet conveying-out section 13, the plural sheets S stored in the sheet storage section 12 are conveyed out inversely on the stacked condition, and are conveyed into a succeeding sheet post processing apparatus FS.

Further, the sheet inversing section 14 is equipped with a sheet conveying path r14 including conveying rollers R7 and R8, and a guide plate 141. In the sheet inversing section 14, the plural sheets S stored in the sheet storage section 12 pass over an upper sheet conveying path r15, are re-inversed by a switchback operation on a sheet conveying path r14, pass over a lower sheet conveying path r16, are discharged from the lower sheet conveying path r16, and are sent into the succeeding sheet post processing apparatus FS.

A conveyance path switching member G2 arranged at the sheet conveying-out section 13 switches a path either one of the sheet conveying path r13 to convey the plural sheets S conveyed from the sheet storage section 12 to the conveying-out drive roller R4 along the guide plate 131 and the sheet conveying path r15 to convey the plural sheet S to the sheet inversing section 14.

A conveyance path switching member G3 arranged at the lower part of the sheet inversing section 14 switches a path either one of the sheet conveying path r15 being opened by the conveyance path switching member G2 and the sheet conveying path r16 to discharge the plural sheets S from the sheet inversing section 14. The conveyance path switching members G1, G2, and G3 are connected with solenoids respectively and are driven by them.

According to the intermediate conveyance unit B described in the above publication, even when preceding sheets are subjected to a post processing, it is possible to stack plural succeeding sheets without making them to interfere with each other and to conduct a lengthwise aligning process at high speed, without stopping conveyance of the plural succeeding sheets.

Moreover, since the stop member 123 constituting the sheet storage section 12 to store the preceding sheets S1 is shifted to the first stop position P1 before the leading end of the succeeding sheet S2 advances into the sheet storage conveyance path r12, the leading end of the succeeding sheet S2 does not interfere with the inversed leading end of the preceding sheet S1, and the succeeding sheet S2 is stacked properly on the preceding sheet S1.

However, in the intermediate conveyance unit B described in the above publication, since the shifting of the stop member 123 from the initial stop position P0 to the first stop position P1 is performed at high speed, even if the stop member 123 is stopped at the first stop position P1, the sheet S1 may proceed excessively according to the inertia of the sheet S1. That is, when the stop member 123 is stopped at the first stop position P1, if the leading end (inversed back end) of the sheet S1 is in close contact with the contact surface of the stop member 123, the back end (the inversed leading end) may locate between the conveying-in drive roller R3 and the conveying-out drive roller R4. However, the leading end separates away from the contact surface of the stop member 123 according to the inertia of the sheet S1. As a result, the inversed leading end of the sheet S1 is pinched between the conveying-out follower roller R11 of the conveyance path switching member G1 and the conveying-out drive roller R4, and there is fear to cause a problem that the sheet S1 is left on the pinched condition even if the stop member 123 is shifted downward to the initial position P0. An occurrence of the phenomenon that the sheet to be shifted downward does not come down without following the stop member 123 being shifted causes problems, such as a conveyance failure of a sheet, and an aligning failure, and further causes a big problem.

SUMMARY OF THE INVENTION

An object of the present invention is to solve the above problems and to provide a sheet aligning apparatus capable of aligning sheets properly and conveying the sheets stably at high speed at the time of performing a post processing and an image forming system equipped with the sheet aligning apparatus.

In order to attain the above object, a sheet aligning apparatus reflecting on aspect of the present invention, comprises:

(1) a sheet storing section having an open end portion through which a sheet is conveyed in or out;

(2) a conveying-in section having a conveying-in path to covey a sheet into the open end portion of the sheet storing section;

(3) a conveying-out section having a conveying-out path to covey out a sheet from the open end portion of the sheet storing section, wherein the conveying-in path and the conveying-out form a meeting point at the open end portion;

(4) a stop member arranged in the sheet storing section so as to oppose the open end portion;

(5) a shifting section to shift the stop member from an initial position to a first position, wherein when the stop member is positioned at the initial position, the stop member comes in contact with a leading end of a preceding sheet conveyed into the sheet storing section through the open end portion, and when the shifting section shifts the stop member from the initial position to the first position, the preceding sheet is shifted inversely together with the stop member and a back end of the preceding sheet proceeds as the inversed leading end from the meeting point to the conveying-out path so that a succeeding sheet is allowed to be conveyed from the conveying-in path into the open end portion;

(6) a shift regulating section to regulate the shift of the preceding sheet when the shifting section shifts the stop member from the initial position to the first position, so that the back end of the preceding sheet is prevented from proceeding more than a predetermined distance due to the inertia of the shift.

DETAILED DESCRIPTION OF THE PREFERRED EMBODIMENT

Figure 1:
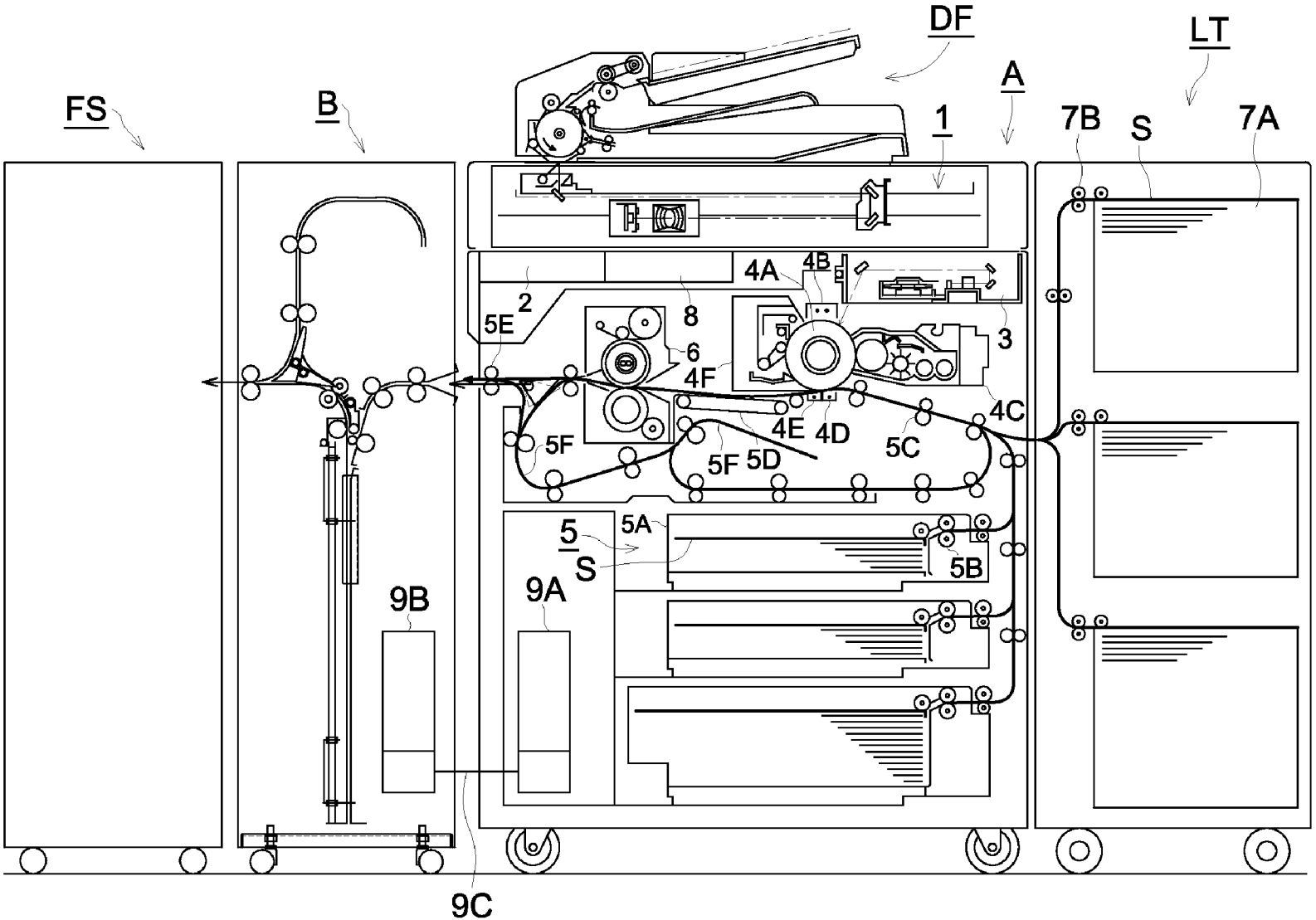
FIG. 1 is an entire structural view of an image forming system according to the present invention which comprises an image forming apparatus main body A, an automatic document sheet feeding apparatus DF, a large amount sheet feeding apparatus LT, an intermediate conveyance unit B, and a sheet post processing apparatus FS.

Although the present invention is explained based on the embodiments indicated in the drawing, the present invention is not limited to these embodiments.

[Image Forming System]

FIG. 1 is an entire configuration view of an image forming system according to the present invention which comprises an image forming apparatus main body A, an automatic document sheet feeding apparatus DF, a large amount sheet feeding apparatus LT, an intermediate conveying-out unit B, and a sheet post processing apparatus FS.

[Image Forming Apparatus Main Body A]

The image forming apparatus main body A shown in the drawing is equipped with an image reading section 1, an image processing section 2, an image writing section 3, an image forming section 4, a feed sheet conveying section 5, and a fixing device 6.

An image forming section 4 is constituted by a photoreceptor drum 4A, a charging section 4B, a developing section 4C, a transferring section 4D, a separating section 4E, and a cleaning section 4F.

The feed sheet conveying section 5 is equipped with a sheet cassette 5A, a first sheet feeding section 5B, a second sheet feeding section 5C, a conveying section 5D, a discharging section 5E, and an automatic double-sided copy sheet feeding section (ADU) 5F.

An operation display section 8 including an input section and a display section is arranged at the upper front side of the image forming apparatus main body A. The automatic document sheet feeding apparatus DF is mounted on the upper part of the image forming device body A. The intermediate conveyance unit B is linked with the discharging section 5E side of the left side plane (illustrated in the drawing) of the image forming apparatus main body A, and the sheet post processing apparatus FS is linked with the further left side.

Images on one side or both sides of document sheets placed on a document stand of the automatic document sheet feeding apparatus DF are read by an optical system of the image reading section 1. Analog signals having been subjected to an photoelectric conversion are further subjected to an analog processing in the image processing section 2, an A/D conversion, a shading correction, an image compression process, and the like, thereafter, are sent to the image writing section 3.

In the image writing section 3, light rays outputted from a semiconductor laser is irradiated onto a photoreceptor drum 4A of the image forming section 4, thereby forming a latent image. In the image forming section 4, an electrically-charging, exposure, development, transfer, separation, cleaning, etc. are performed.

An image is transferred by a transferring section 4D onto a sheet S fed by the first sheet feeding section 5B. The sheet S carrying the image is fixed by the fixing device 6, and is sent into an intermediate conveyance unit B from the discharging section 5E. Alternately, the sheet S on the one side of which an image has been formed is sent into the automatic double-sided copy sheet feeding section 5F so as to form an image on another side of the sheet in the image forming section 4. After the double-sided image processing, the sheet S is again discharged by the discharging section 5E, and is sent into the intermediate conveyance unit B.

A communication section of the control section 9A arranged in the image forming apparatus main body A and a communication section of the control section 9B arranged in intermediate conveyance unit B are connected via a communication line 9C, and transmits and receives an input signal and a control signal.

Moreover, the control section 9B controls the operations of each part in intermediate conveyance unit B through transmission and receipt of signals with the control section DA.

[Large Amount Sheet Feeding Apparatus LT]

The large amount sheet feeding apparatus LT is constituted by a sheet stack section 7A and a first sheet feeding section 7B, and feeds out a large amount of sheets S continuously into the image forming apparatus main body A.

[Intermediate-Conveyance-Unit B]

Figure 16:
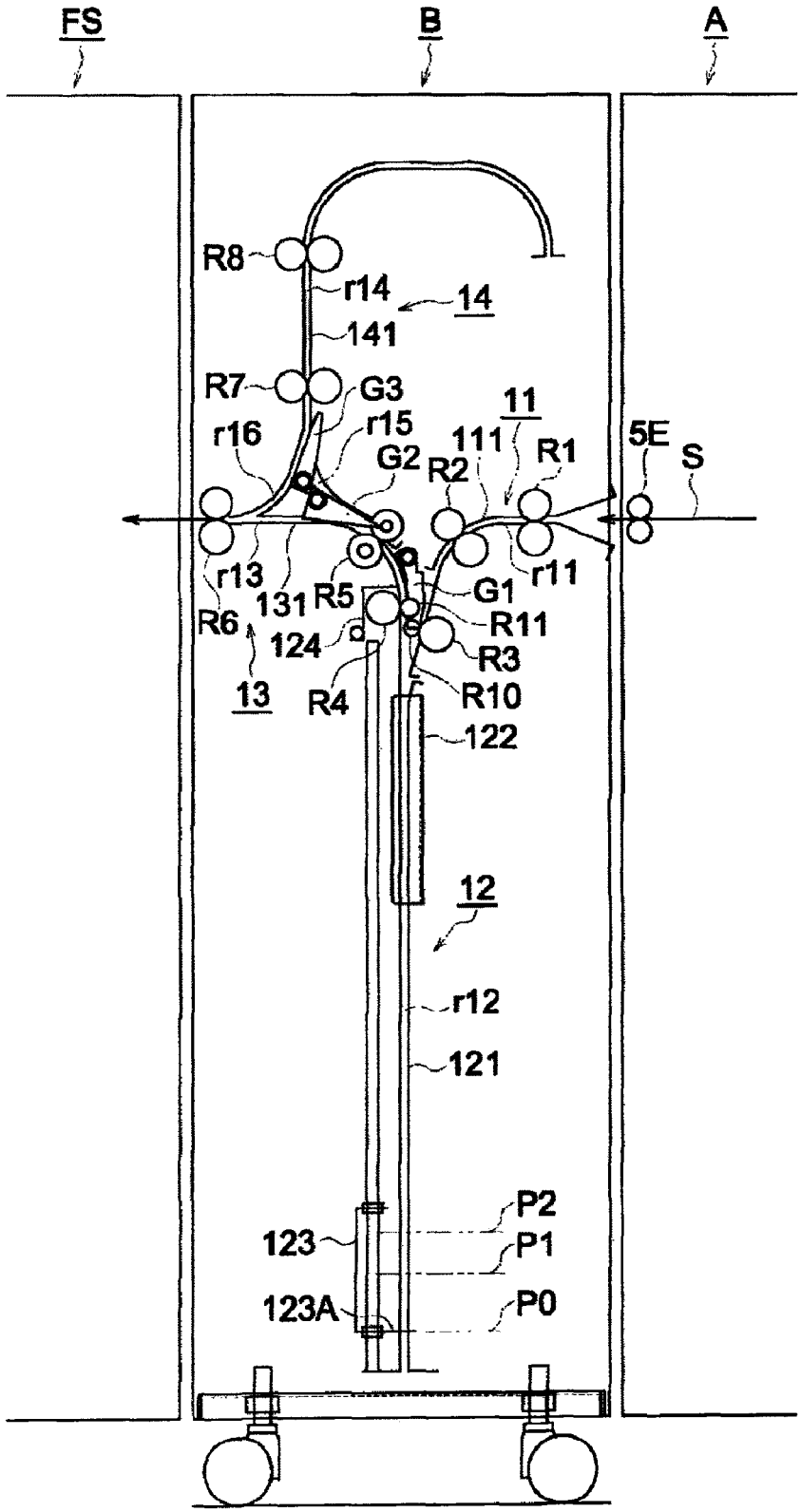
FIG. 16 PRIOR ART
FIG. 16 is a front side cross sectional view of an intermediate conveyance unit B disclosed by Patent document 1.

The structure and operations of the sheet aligning apparatus B1 constituting a part of the intermediate conveyance unit B according to the present invention are similar to those of the conventional example explained with reference to FIG. 16, and a member having the same function is applied with the same reference symbol. Therefore, the explanation for such a member is omitted, and different structures and different operations are explained hereafter.

The sheet aligning apparatus B1 according to the present invention shall is an apparatus with a structure adding a conveyance path switching member G1 to a sheet storage section 12.

Hereafter, in the sheet aligning apparatus B1 according to the present invention, the structures and operations of the first, second and third embodiments are explained with reference to the drawing.

Figure 2:
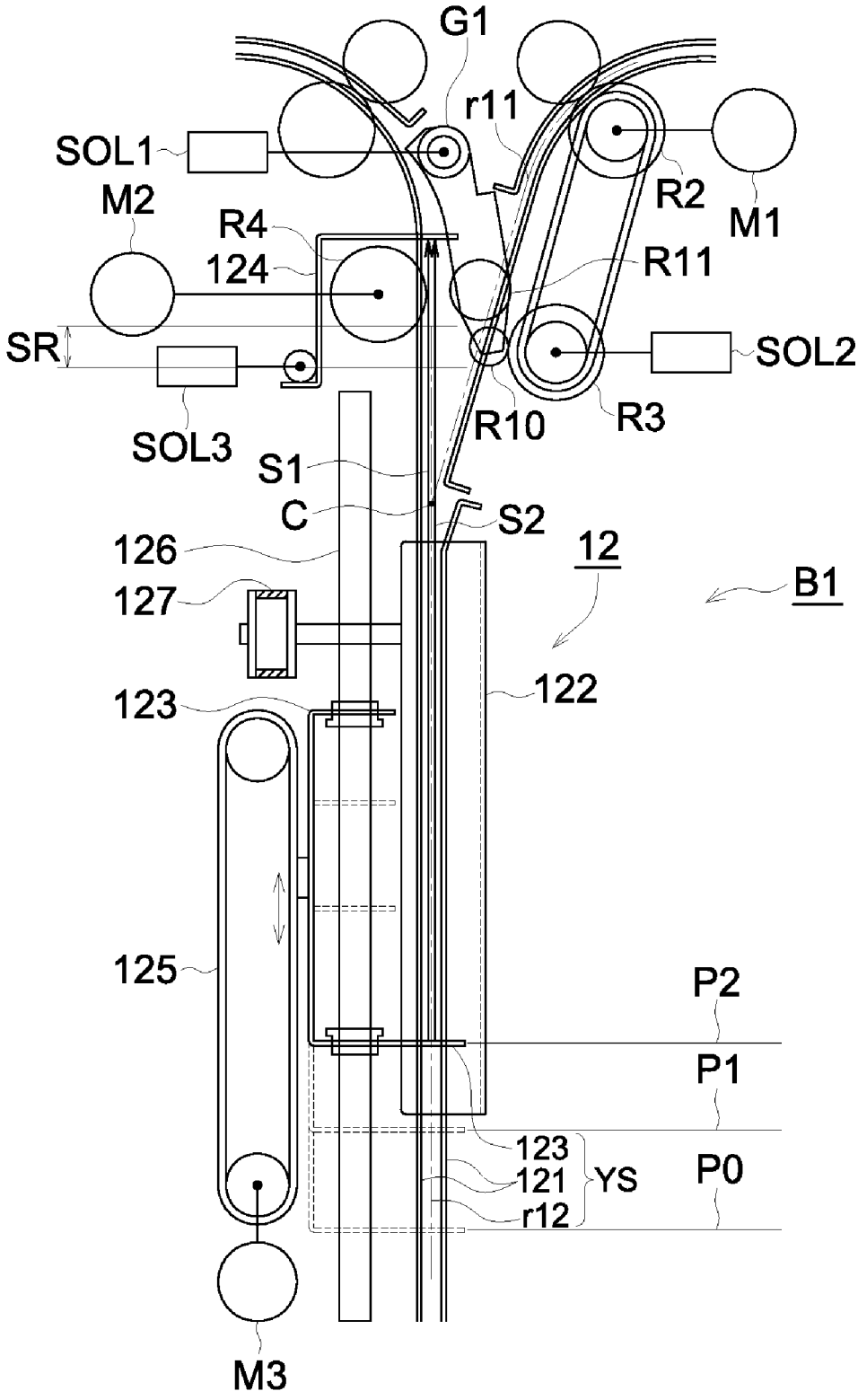
FIG. 2 is a schematic structural view for explaining the structure and operations of a driving section of the first embodiment of a sheet aligning apparatus B1 according to the present invention.

FIG. 2 is a schematic structural diagram for explaining the structures and operations of a driving section of the first embodiment in the sheet aligning apparatus B1 according to the present invention.

In FIG. 2, the conveyance path switching member G1 which supports a conveying-in follower roller R10 as a sheet conveying-in section and a conveying-out follower roller R11 is driven and rocked by a solenoid SOL1. The conveying-in drive roller R3 is driven by a solenoid SOL2 so as to open and close the sheet conveying-in conveyance path r11. A lengthwise aligning member 124 for aligning sheets in the sheet conveying direction is driven and rocked by a solenoid SOL3.

A motor M1 as a conveying-in roller driving section drives and rotates a conveying roller R2, and rotates a conveying-in drive roller R3 through a belt.

A motor M2 as a conveying-out roller driving section drives and rotates a conveying-out drive roller R4 as a sheet conveying-out section.

The stop member 123 is shifted by a stop member shifting section, and the stop member shifting section is constituted by a motor M3 with a changeable speed, a belt 125, a guide bar 126 and so forth. The stop member 123 is attached to a belt 125 being rotated by a motor M3, is guided by a guide bar 126, and shifts up and down between an initial stop position P0 and a first stop position P1 or between the initial stop position P0 and a second stop position P2.

A sheet shifting section YS as a sheet storage section according to the present invention is constituted by the stop member 123 capable of shifting and a sheet storage conveyance path r12 formed by two guide plates 121, and shifts sheets along a sheet storage conveyance path r12.

Here, since sheets S are inversely conveyed in the sheet shifting section YS according to the present invention, the sheet conveying-out direction is made inverse to the sheet conveying-in direction. Therefore, the leading end of a sheet in the sheet conveying-in direction is the same portion of the back end (the inversed back end) of the sheet in the sheet conveying-out direction.

Further, two rollers of the conveying-in drive roller R3 and the conveying-in follower roller R10 which come in pressure contact with each other in order to convey a sheet S from the sheet conveying-in conveyance path r11 into the sheet shifting section YS are named generically as a sheet conveying-in roller pair. The sheet conveying-in roller pair is arranged on a sheet conveying-in conveyance path r11 located at an upstream side from a juncture C in the sheet conveying-in direction.

Furthermore, two rollers of the conveying-out drive roller R4 and the conveying-out follower roller R11 which come in pressure contact with each other in order to convey out a sheet S from the sheet shifting section YS into the next process are named generically as a sheet conveying-out roller pair. The sheet conveying-out roller pair is arranged on a sheet storage conveyance path r12 located at a downstream side from a juncture C in the sheet conveying-out direction.

The first embodiment according to the sheet aligning apparatus B1 of the present invention differs from the conventional example explained with reference o FIG. 16 in the point that a shifting speed Vb1 of the stop member 123 from the initial stop position P0 to the first stop position P1 is controlled by the control section 9B. That is, a motor capable of changing a speed, such as a stepping motor, is used as the motor M3 as a stop member shifting section, and a shifting speed at the time of shifting the stop member 123 from the initial stop position P0 to the first stop position P1 is changed in order to make the inertia moment of the stop member 123 small.

Hereafter, the control method of the speed control in the first embodiment according to the sheet aligning apparatus B1 of the present invention is explained with reference to FIG. 3.

Figure 3:
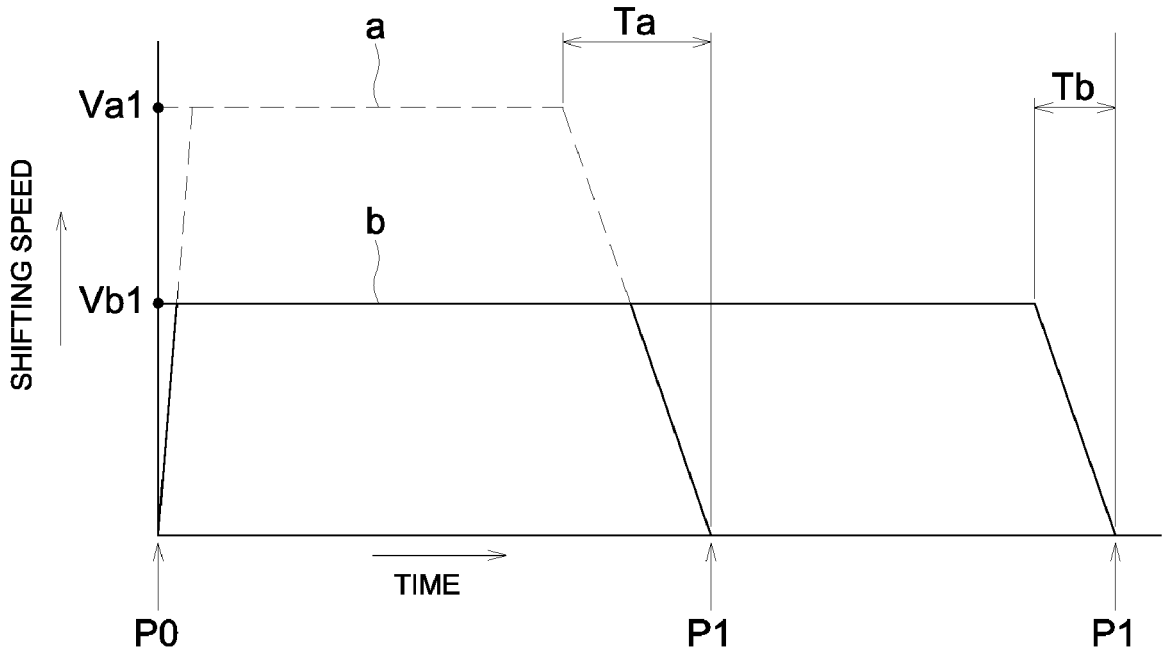
FIG. 3 is a graph for explaining a control method for a shifting speed of a stop member 123 in the first embodiment according to a sheet aligning apparatus B1 of the present invention.

FIG. 3 shows a graph for explaining the control method of the shifting speed of the stop member 123 in the first embodiment according to the sheet aligning apparatus B1 of the present invention.

In FIG. 3, an axis of ordinate shows change of the shifting speed at the time of shifting the stop member 123 from the initial stop position P0 to the first stop position P1, and an axis of abscissa shows necessary time at the time of shifting the stop member 123 from the initial stop position P0 to the first stop position P1. The dotted line a is a line which shows the speed change in the conventional example in which the shifting speed Va1 of the stop member 123 is made an usual sheet conveying speed, and the solid line b is a line which shows the speed change when the shifting speed Vb1 of the stop member 123 is controlled by the stop member shifting section according to the present invention. The sign "Ta" shows the speed reducing time in the conventional example, and the sign "Tb" shows the speed reducing time in the present invention.

Example

The present inventor conducted the comparative experiment between Example 1 and Comparative example 1 with reference to the influence of the inertia provided to a sheet S1 by the shifting speed at the time of shifting the stop member 123 from the initial stop position P0 to the first stop position P1.

Comparative Example 1

In Comparative example 1, the shifting speed Va1 of the stop member 123 was made to 600 mm/s of the usual sheet conveying speed, and the speed reducing time Ta was set to 15 m.

Example 1

In Example 1, in order to reduce the inertia moment provided to a sheet, the shifting speed Vb1 of the stop member 123 was made to 300 mm/s slower than the usual sheet conveying speed, and the speed reducing time Ta was set to 9 ms.

The result of the comparative experiment is shown in Table 1.

TABLE 1

| | Shifting speed | Speed reducing time | Result |
|---|---|---|---|
| Comparative example | 600 mm/s | 15 ms | Yes |
| Example | 300 mm/s | 9 ms | No |

Yes: A conveyance failure was occurred
No: A conveyance failure was not occurred In Comparative example 1, at the time of shifting the stop member 123 to the first stop position P1, the position of the inversed leading end of a sheet S1 in the sheet conveying-out direction passed over a predetermined region SR due to the inertia of the sheet S1, and reached the downstream side in the sheet conveying direction from the position of the nip section between the conveying-out drive roller R4 and the conveying-out follower roller R11. Thereafter, when the conveying-out follower roller R11 was returned to a position to come in contact with the conveying-out drive roller R4 to form a nip section by the switching operation of the conveyance path switching member G1, the inversed leading end of the sheet S1 was pinched by the nip section, and a conveyance failure occurred.

In Example 1 in which the shifting speed Vb1 of the stop member 123 was controlled, at the time of shifting the stop member 123 to the first stop position P1, the position the inversed leading end of a sheet S1 in the sheet conveying-out direction was located at a position in predetermined region SR. As a result, by the switching operation of the conveyance path switching member G1, the inversed leading end of the sheet S1 is not pinched by the above-mentioned nip section, and conveyance failure did not occur.

Here, in this experiment, on the condition that the stop member 123 was stopped at the first stop position P1 and the inversed back end of a sheet S1 was in contact with the stopping surface 123A of the stop member 123, the distance from the inversed leading end of the sheet S1 in the sheet conveying-out direction to the nip section was set to 12 mm.

Although the shifting speed Vb1 of the stop member 123 was made to 300 mm/s in Example 1, the shifting speed Vb1 is not limited to this speed. As far as a speed can refrain the inertia of a sheet, the speed can be employed as the shifting speed Vb1. Moreover, the speed is not necessary to be changed linearly, and can be changed to increase or decrease in a curve shape smoothly.

By employing the speed control method of the first embodiment speed according to the sheet aligning apparatus B1 of the present invention, the inertia moment due to the shifting of the stop member 123 can be reduced. As a result, it is possible to prevent a sheet from being moved across a predetermined region and to avoid resultant conveyance failure.

Figure 4:
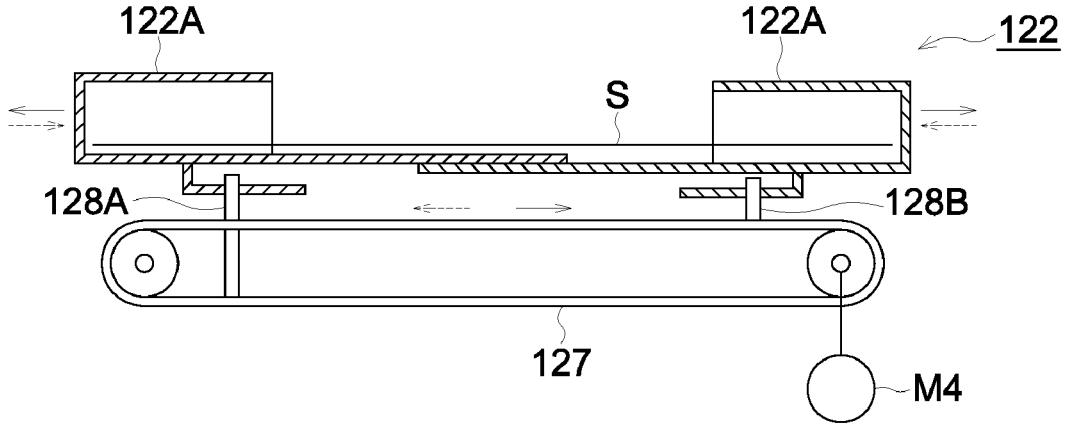
FIG. 4 is a cross sectional view showing a driving section of a widthwise aligning section 122.

FIG. 4 is a cross sectional view showing a driving section of a widthwise aligning section 122.

The widthwise aligning section 122 is constituted by widthwise aligning plates 122A of a right and left pair, a motor M4, a belt 127, pins 128A and 128B, etc.

The widthwise aligning plates 122A of a right and left pair are engaged with pins 128A and 128B attached to a belt 127 being rotated by a motor M4, and are adapted to be moved with the pins in the sheet width direction so as to perform the widthwise aligning of sheets S.

FIGS. 5 to 8 are cross sectional views showing respectively a sheet conveyance process in the first embodiment according to the sheet aligning apparatus B1 of the present invention. Hereafter, the sheet conveyance process in the first embodiment of the sheet aligning apparatus B1 will be explained with reference to FIGS. 5 to 8.

Figure 5:
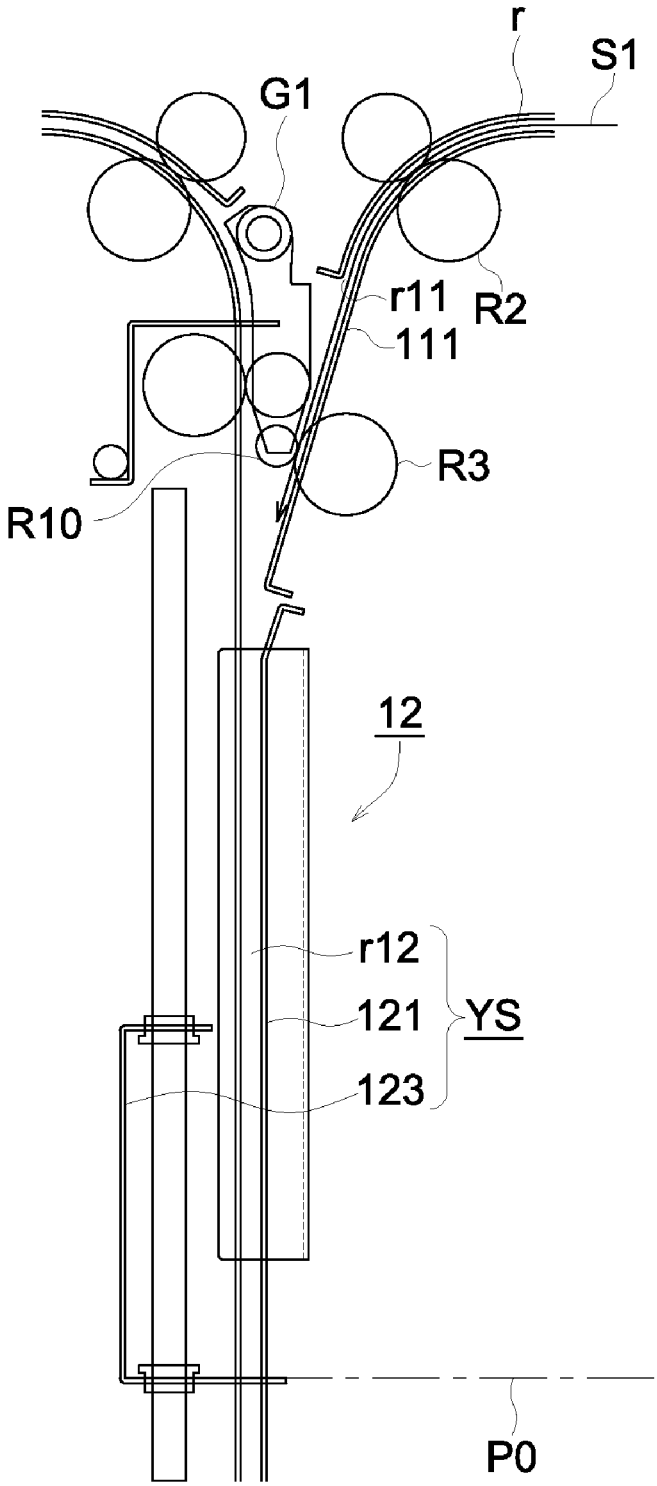
FIGS. 5(*a*) and 5(*b*) each is a cross sectional view showing a sheet conveyance process in the first embodiment according to a sheet aligning apparatus B1 of the present invention.
Figure 5:
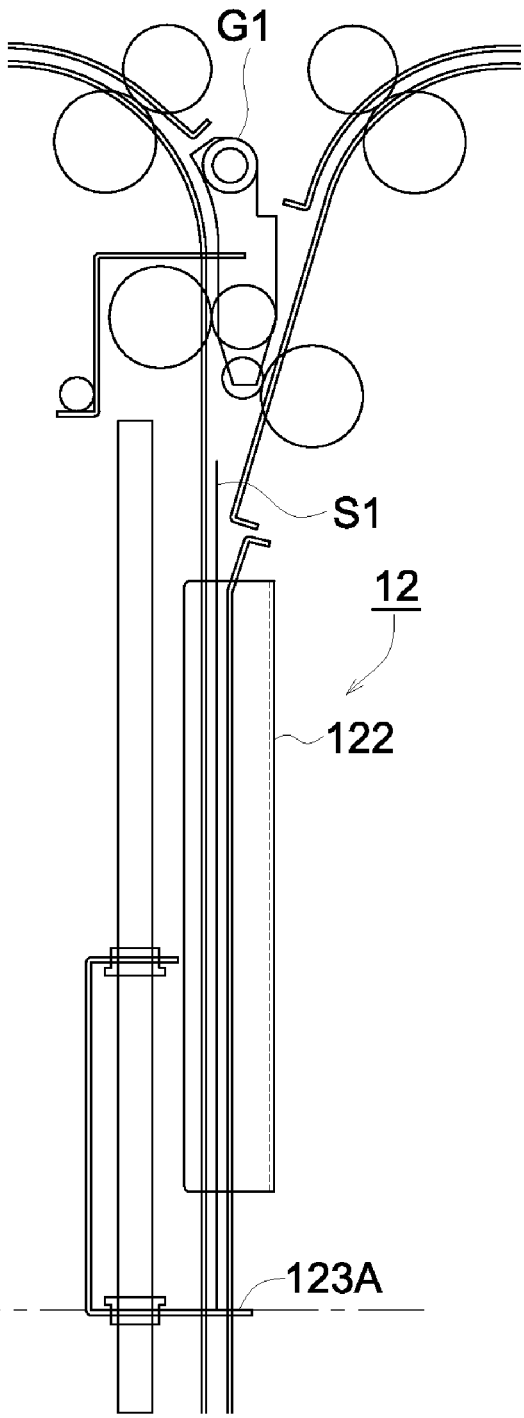

(1) In FIG. 5(*a*), the conveying-in follower roller R10 supported rotatably by the lower end of the conveyance path switching member G1 is brought in contact with the conveying-in drive roller R3 rotating with a driving force, and is driven with a following rotation. The first preceding sheet S1 pinched and conveyed by the conveying roller R2 rotating with a driving force is conveyed along the guide plate 111 on the sheet conveying-in conveyance path r11, then, is pinched and conveyed by the conveying-in drive roller R3, and advances towards the sheet shifting section YS of the sheet storage section 12.

(2) In FIG. 5(*b*), the leading end of the first preceding sheet S1 conveyed into the sheet shifting section YS comes in contact with the stopping surface 123A of the stop member 123 being waiting at the initial stop position P0, and the first preceding sheet S1 stops there.

Figure 6:
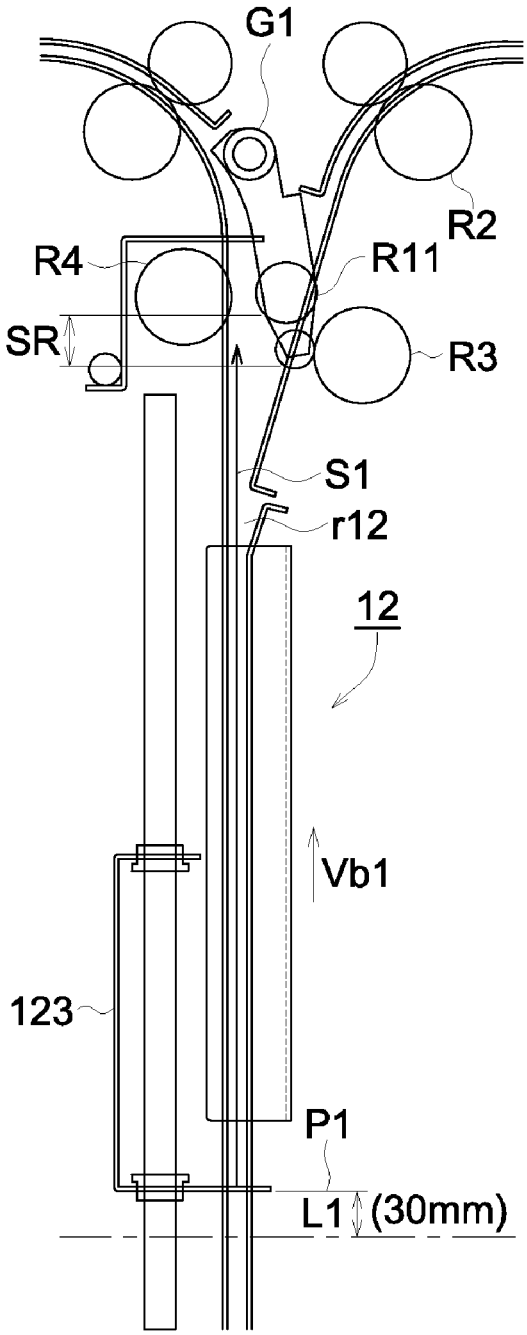
FIGS. 6(*a*) and 6(*b*) each is a cross sectional view showing a sheet conveyance process in the first embodiment according to a sheet aligning apparatus D1 of the present invention.
Figure 6:
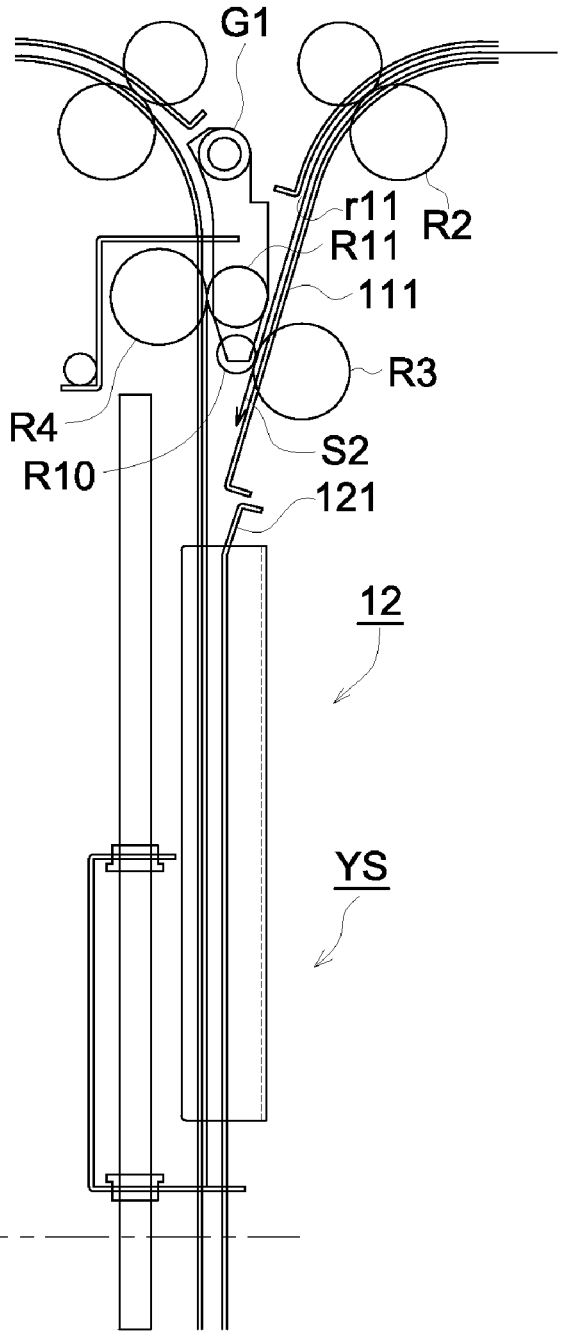

(3) In FIG. 6(*a*), the conveyance path switching member G1 is actuated to separate the conveying-out follower roller R11 supported rotatably at an intermediate position of the conveyance path switching member G1 away from the conveying-out drive roller R4. At this time, the conveying-in drive roller R3 is pushed by the conveyance follower roller R11 so as to be rocked around the conveying roller R2 as the center of rocking, and is retracted from the sheet conveying-in conveyance path r11 to the outside of the path. Then, the stop member 123 is shifted to the first stop position P1 located upward by only the predetermined distance L1 (for example, 30 mm) from the initial stop position P0 by a motor M3 as a stop member shifting section, whereby the inversed leading end of the first preceding sheet S1 reaches to the predetermined region SR, and stops there.

Here, the predetermined region SR in this embodiment section is a region between a position at the downstream side in the sheet conveying-out direction from the junction of the sheet conveying-in conveyance path r11 and the sheet storage conveyance path r12 and a position of the upstream side in the sheet carrying-out direction from the nip section of the conveying-out drive roller R4 and the conveying-out follower roller R11. More concretely, the predetermined region SR is a region in which the position of the inversed leading end in the sheet conveying-out direction of the preceding sheet S1 being moved with the shifting of the stop member 123 does not interfere with the position of the leading end in the sheet conveying-in direction of the succeeding sheet S2 being conveyed in from the sheet conveying-in conveyance path r11. That is, if the position of the inversed leading end in the sheet conveying-out direction of the preceding sheet S1 is within the range of the predetermined region SR, the position of the leading end in the sheet conveying-in direction of the succeeding sheet S2 being conveyed in from the sheet conveying-in conveyance path r11 is located below from the predetermined region SR and does not interfere with the preceding sheet S1.

According to the structure of the first embodiment according to the sheet aligning apparatus B1 of the present invention, since the shifting speed of the stop member 123 at the time of stopping at the first stop position P1 is controlled, it is possible to prevent the phenomenon that the inversed leading end of the preceding sheet S1 passes over predetermined region SR due to inertia and reaches the conveying-out drive roller R4. Therefore, it is possible to prevent the problem that the inversed leading end of a sheet S1 is pinched between the conveying-out drive roller R4 and the conveying-out follower roller R11 of the conveyance path switching member G1 returning from the retracting position and the sheet S1 is left on the pinched condition even if the stop member 123 is shifted downward.

(4) In FIG. 6(*b*), the conveyance path switching member G1 returns, and simultaneously the conveying-in drive roller R3 returns to the sheet conveying-in conveyance path r11 and the conveying-in drive roller R3 rotating with a driving force comes in pressure contact with the carrying-in follower roller R10. Simultaneously, in the sheet storage conveyance path r12, the conveying-out drive roller R4 and the conveying-out follower roller R11 come in pressure contact with each other. The second succeeding sheet S2 pinched and conveyed by the conveying roller R2 is conveyed along the guide plate 111 of the sheet conveying-in conveyance path r11, then pinched and conveyed by the conveying-in drive roller R3 and the carrying-in follower roller R10, and advances toward the sheet shifting section YS.

Figure 7:
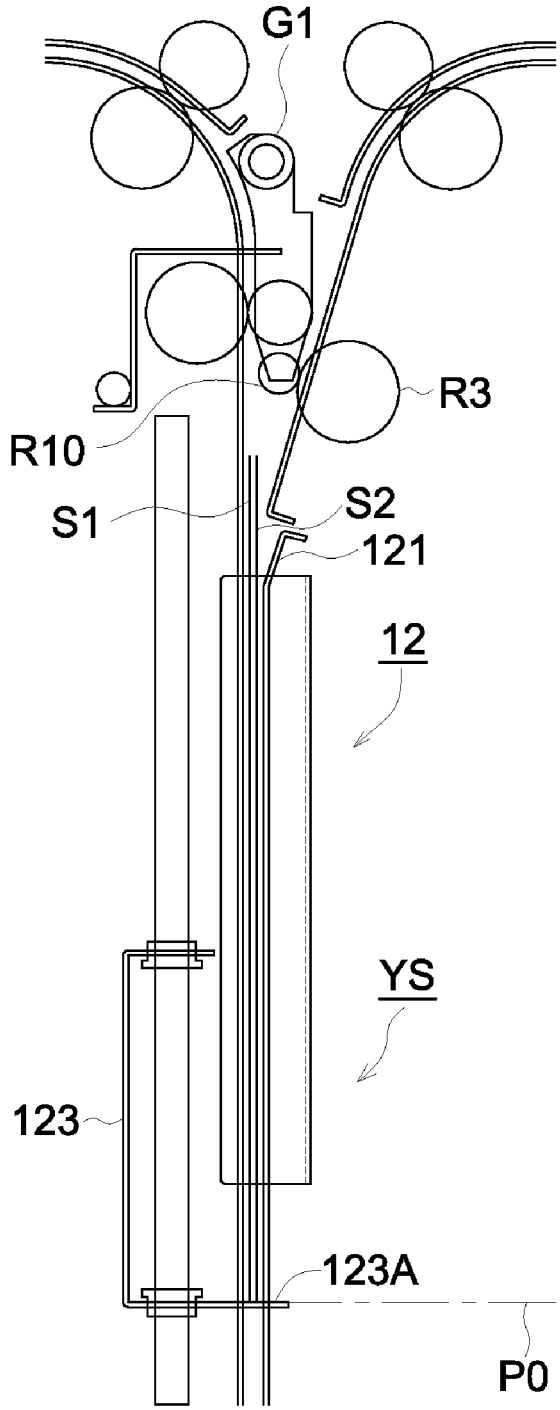
FIGS. 7(*a*) and 7(*b*) each is a cross sectional view showing a sheet conveyance process in the first embodiment according to a sheet aligning apparatus B1 of the present invention.
Figure 7:
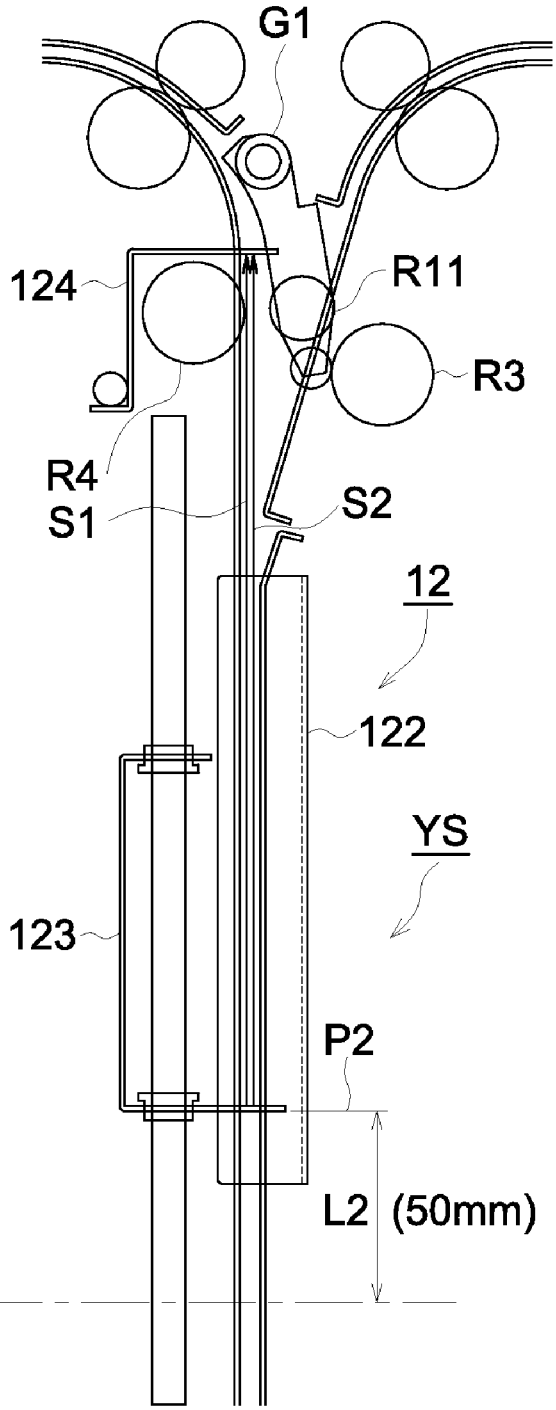

(5) In FIG. 7(*a*), the second succeeding sheet S2 is conveyed along the guide plate 121 of the sheet storage conveyance path r12, and after its leading end passes over the separated nip section of the conveying-in drive roller R3 and the conveying-in follower roller R10, the stop member 123 is returned to the initial stop position P0. The leading end of the second succeeding sheet S2 comes in contact with the stopping surface 123A of the stop member 123 of the sheet storage section YS, and stops there. At this initial stop position P0, the second succeeding sheet S2 is made on the condition that its whole surface is superimposed on the top of the preceding first sheet S1.

In the present embodiment, the predetermined number of sheets stored in the sheet storing section Y is set to two sheets. Therefore, when the number of sheets S stored in the sheet storing section Y becomes two sheets, the sheets S are conveyed out from the sheet storing section Y through the sheet storing path r12.

(6) In FIG. 7(*b*), as same as in FIG. 6(*a*), the conveyance path switching member G1 is actuated to separate the conveying-out follower roller R11 from the conveying-out drive roller R4. Then, the stop member 123 is shifted by a motor M3 above to a second stop position P2 by the predetermined distance L2 (for example, 50 mm) from the initial stop position P0, wherein the second stop position P2 is located above further from the first stop position P1 located above by the predetermined distance L1 from the initial stop position P0. At this time, the top end (the inversed leading end) of the stacked two sheets S1 and S2 comes in contact with the stopping surface 124A of the lengthwise aligning member 124, and stops there, and the lengthwise aligning of the two sheets S1 and S2 is carried out with high precision. The stop position of the top end (the inversed leading end) of the two sheets S1 and S2 having been lengthwise aligned is located at the downstream side in the conveying direction from the nip position of the conveying-out drive roller R4. At the same time with the lengthwise aligning or after it has been completed, a widthwise aligning section 122 is driven by a motor M4 to conduct a widthwise aligning by pressing the side edges of the sheets S1 and S2 in a width direction.

Figure 8:
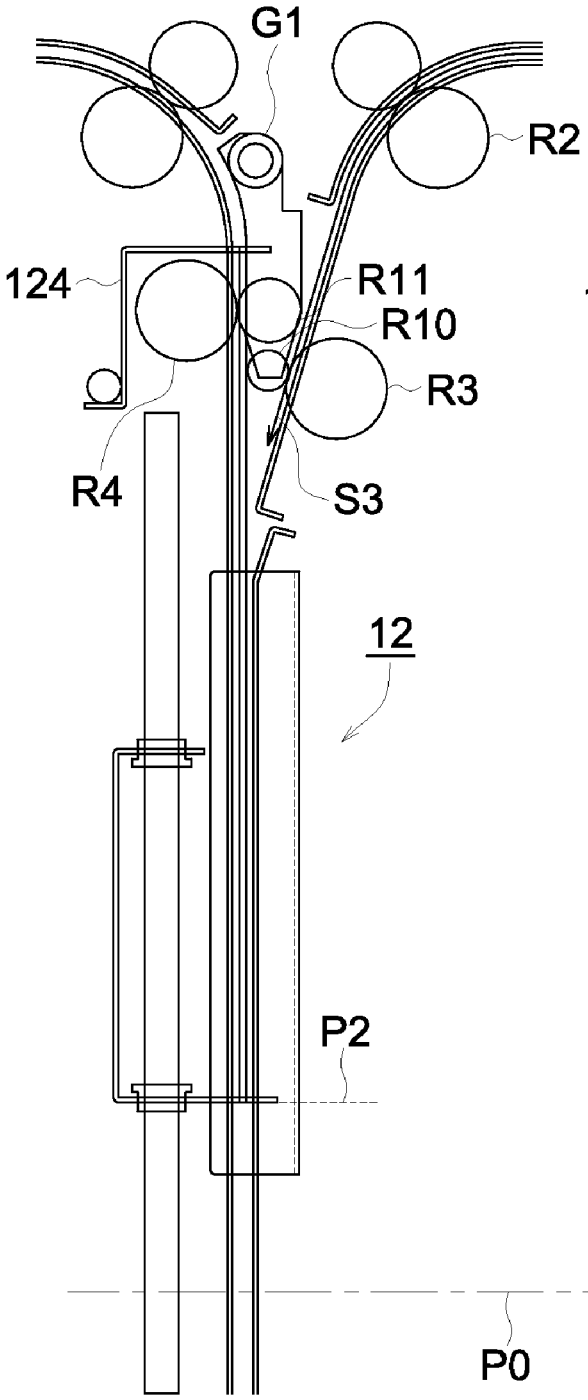
FIGS. 8(*a*) and 8(*b*) each is a cross sectional view showing a sheet conveyance process in the first embodiment according to a sheet aligning apparatus B1 of the present invention.
Figure 8:
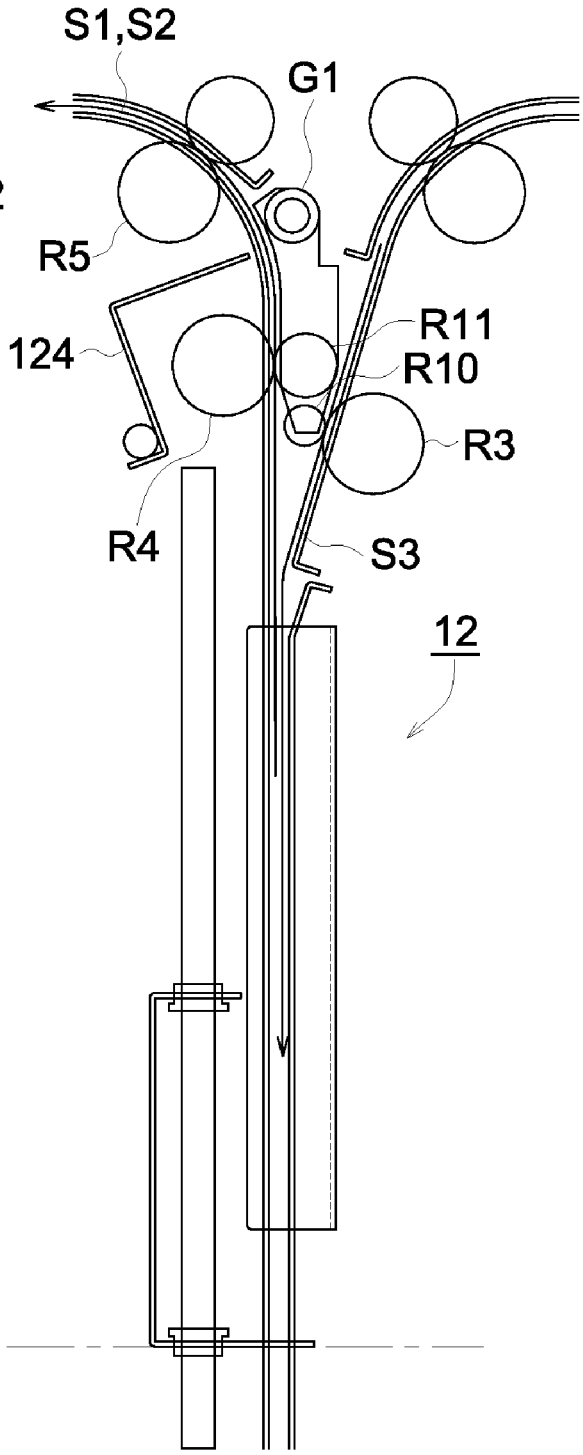

(7) In FIG. 8(*a*), as same as in FIG. 6(*b*), the conveyance path switching member G1 returns, and at the same time, the conveying-in drive roller 23 also returns. Then, the conveying-in drive roller R3 rotating with a driving force and the carrying-in follower roller R10 come in contact with each other and pinch the leading end of the third sheet S3 so as to make it possible to convey the third sheet S3. Simultaneously, the conveying-out drive roller R4 and the conveying-out follower roller R11 come in contact with each other and pinch the top end (the inversed leading end) of the stacked sheets S1 and S2.

(8) In FIG. 8(*b*), the lengthwise aligning member 124 is actuated by a solenoid SOL3 and retracts from the sheet conveying path r13. The two sheets S1 and S2 pinched between the conveying-out drive roller R4 and the conveying-out follower roller R11 are conveyed by the rotation of the conveying-out drive roller R4, and subsequently the two sheets S1 and S2 are pinched by an intermediate conveying roller R5, and is discharged to a next step. Almost the same time, the third sheet S3 pinched between the conveying-in drive roller R3 and the conveying-in follower roller R10 is conveyed and proceeds towards the sheet storage section 12.

Here, although the number of sheets of the sheet S stored in the sheet storage section 12 is made two sheets in this embodiment, the present invention is not limited to this embodiment. It may be structured that the number of sheets is set in accordance with the post processing characteristic of the post processing apparatus FS connected to the sheet aligning apparatus B1.

Figure 9:
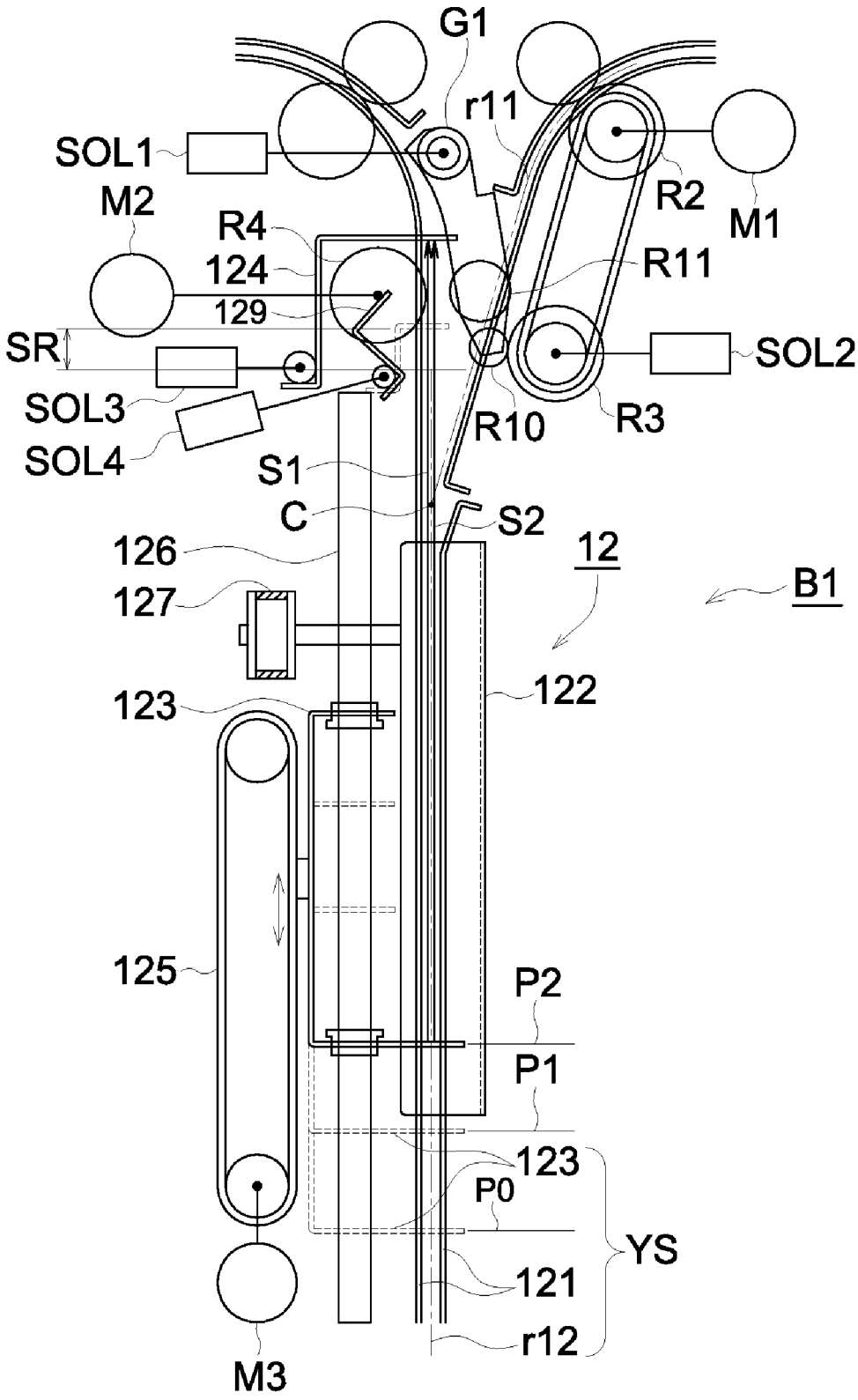
FIG. 9 is a schematic structural view for explaining the structure and operations of a driving section of the second embodiment according to a sheet aligning apparatus B1 of the present invention.

FIG. 9 is a schematic structural diagram for explaining the structure and operations of a driving section of the second embodiment according to the sheet aligning apparatus B1 of the present invention.

The driving section of the second embodiment of the sheet aligning apparatus B1 is similar to the driving section of the first embodiment and a member having the same function is applied with the same reference symbol. Therefore, the explanation for such a member is omitted, and different structures and different operations are explained with reference to drawing.

The point of the second embodiment different from the first embodiment is a point that a sheet regulating member 129 is arranged in order to prevent the inversed leading end of a sheet S1 from proceeding over without stopping a predetermined region SR when the stop member 123 is shifted from the initial stop position P0 to the first stop position P1.

In FIG. 9, the sheet regulating member 129 is arranged at an upstream position (within the boundary of predetermined region SR) in the sheet conveying direction from the conveying-out drive roller R4 on the sheet storage conveyance path r12, and is structured to be rockable so as to proceed on or retract from the sheet storage conveyance path r12. The rocking action of the sheet regulating member 129 is driven by a solenoid SOL4 as a sheet regulating member driving section connected with a well-known link mechanism.

The sheet regulating member 129 is actuated to proceed onto the sheet storage conveyance path r12 (the position indicated with a dotted line in FIG. 9) at the time of shifting (lifting) up the stop member 123 from the initial stop position P0 to the first stop position P1. Further, at the time of shifting (lowering) down the stop member 123 from the first stop position P1 to the initial stop position P0, the sheet regulating member 129 is actuated to retract from the sheet storage conveyance path r12 (the position indicated with a solid line in FIG. 9).

A sheet S1 moves with the movement of the stop member 123 being shifted from the initial stop position P0 to the first stop position P1. When the stop member 123 stops at the first stop position P1, the position of the inversed leading end of the sheet S1 in the conveying-out direction tends to go up and pass over the predetermined region SR due to the inertia of the sheet S1. At this time, since the sheet regulating member 129 proceed into the sheet storage conveyance path r12, the inversed leading end of the sheet S1 in the conveying-out direction comes in contact with the sheet regulating member 129, whereby the going-up of the sheet S1 is regulated.

According to the second embodiment, even if the shifting speed of the stop member 123 being shifted from the initial stop position P0 to the first stop position P1 is fast, the inversed leading end of the sheet S1 in the conveying-out direction is stopped within the predetermined region SR. For this reason, the inversed leading end of the sheet S1 in the conveying-out direction does not reach the nip section between the conveying-out drive roller R4 and the conveying-out follower roller R11, whereby it is possible to prevent the problem that the sheet S1 is pinched by the nip section and a conveyance failure is caused by the pinched sheet S1.

Figure 10:
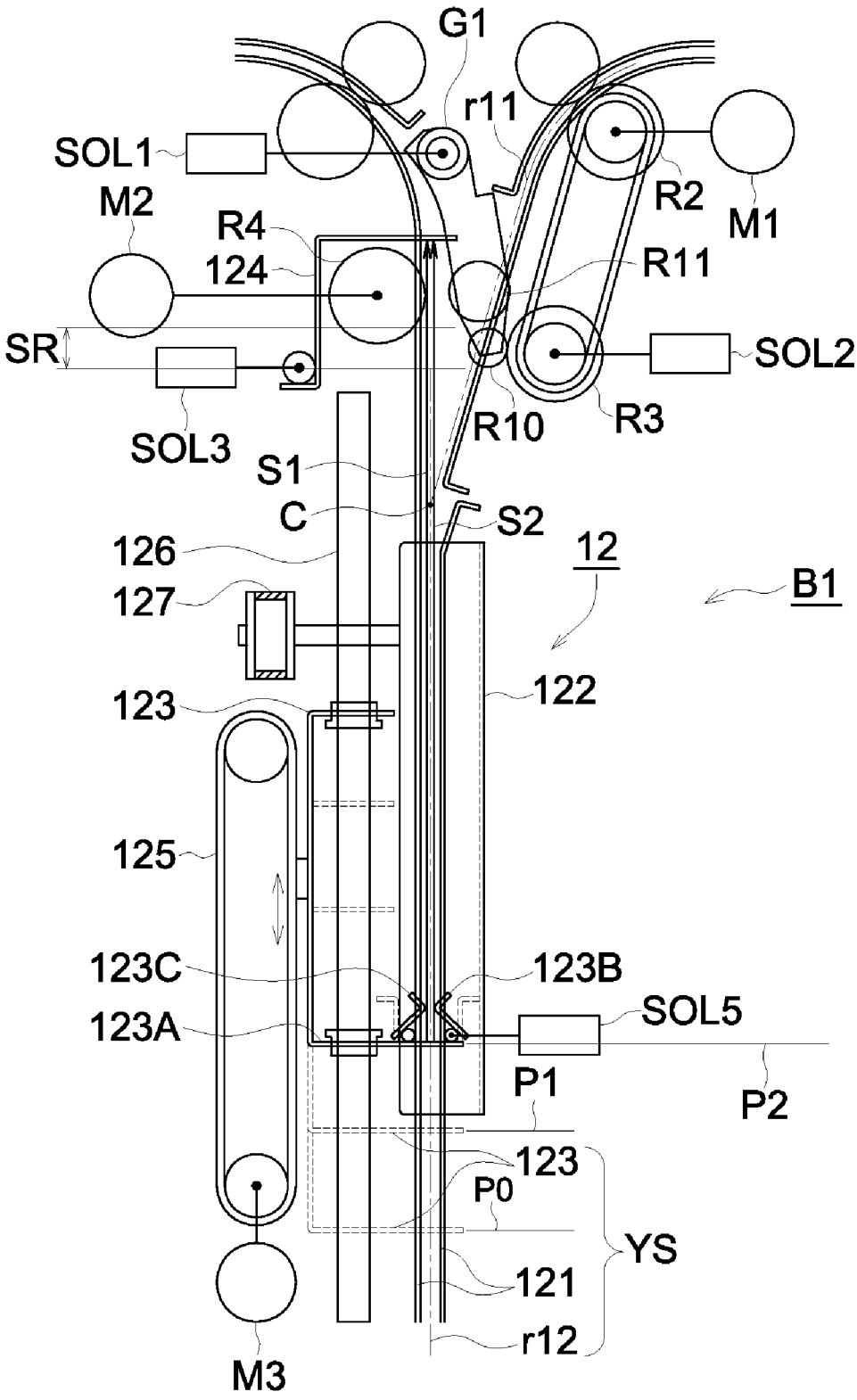
FIG. 10 is a schematic structural view for explaining the structure and operations of a driving section of the third embodiment according to a sheet aligning apparatus B1 of the present invention.

FIG. 10 is a schematic structural diagram for explaining the structure and operations of the driving section of the third embodiment according to the sheet aligning apparatus B1 of the present invention.

The driving section of the third embodiment of the sheet aligning apparatus B1 is similar to the driving section of the first embodiment and a member having the same function is applied with the same reference symbol. Therefore, the explanation for such a member is omitted, and different structures and different operations are explained with reference to drawing.

The point of the third embodiment different from the first embodiment is a point that sheet pinching members 123B and 123C capable of contacting to or separating from a sheet S1 are arranged in order to prevent the inversed leading end of a sheet S1 from passing over a predetermined region SR due to inertia when the stop member 123 is shifted from the initial stop position P0 to the first stop position P1.

In FIG. 10, the sheet pinching members 123B and 123C are arranged on the stop member 123 so as to be rockable, and are structured to pinch the both sides of a sheet S1 at a portion near the inversed back end of the sheet S1 coming in contact with the stopping surface 123A of the stop member 123. The rocking action of the sheet pinching members 123B and 123C is driven by a solenoid SOL5 as a sheet pinching member driving section connected with a well-known link mechanism.

The sheet pinching members 123B and 123C are actuated to pinch the sheet S1 (the position indicated with a solid line in FIG. 10) at the time of shifting (lifting) up the stop member 123 from the initial stop position P0 to the first stop position P1. Further, at the time of shifting (lowering) down the stop member 123 from the first stop position P1 to the initial stop position P0, the sheet pinching members 123B and 123C are actuated to separate from the sheet S1 (the position indicated with a dotted line in FIG. 10).

A sheet S1 moves with the movement of the stop member 123 being shifted from the initial stop position P0 to the first stop position P1. When the stop member 123 stops at the first stop position P1, the position of the inversed leading end of the sheet S1 in the conveying-out direction tends to separate from the stopping surface 123A of the stop member 123 and go up due to the inertia of the sheet S1. At this time, since the sheet pinching members 123B and 123C pinch the neighborhood of the inversed back end of the sheet S1, the going-up of the sheet S1 is refrained.

According to the third embodiment, even if the shifting speed of the stop member 123 being shifted from the initial stop position P0 to the first stop position P1 is fast, the neighborhood of the inversed back end of the sheet S1 is pinched, and the going-up of the sheet S1 is refrained, whereby the inversed leading end of the sheet S1 is stopped within the predetermined region SR. For this reason, the inversed leading end of the sheet S1 does not reach the nip section between the conveying-out drive roller R4 and the conveying-out follower roller R11, whereby it is possible to prevent the problem that the sheet S1 is pinched by the nip section and a conveyance failure is caused by the pinched sheet S1.

Figure 11:
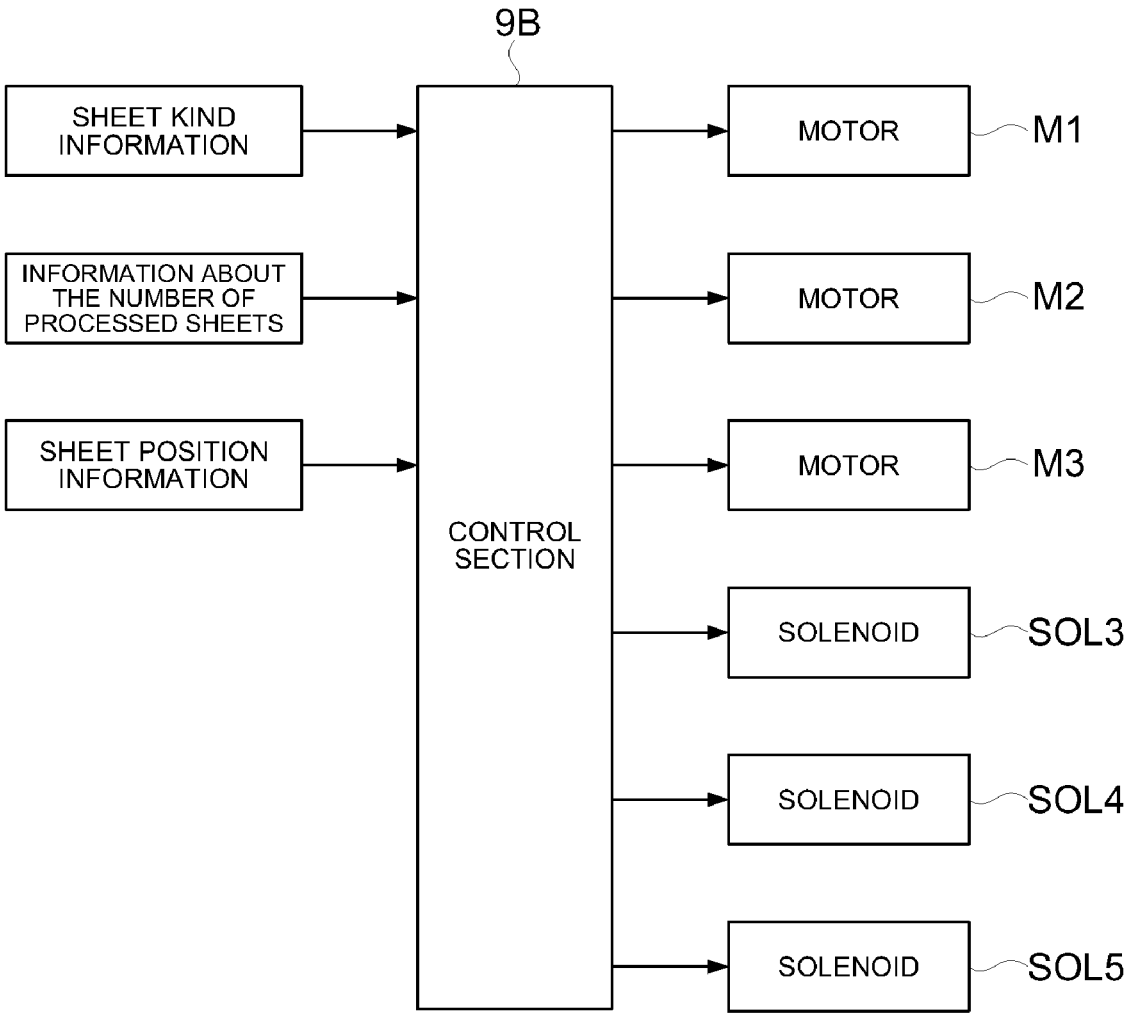
FIG. 11 is a control block diagram showing a command system at the time of controlling each part by a control section 9B in the first to third embodiment of the sheet aligning apparatus B1 according to the present invention.

FIG. 11 is a control block diagram showing a command system at the time of controlling operations of each part by the control section 9B in the first to third embodiments of the sheet aligning apparatus B1 according to the present invention.

As shown in FIG. 11, the control section 9B controls the operations of motors M1, M2, M3 and solenoids SOL3, SOL4, and SOL5 in response to sheet kind information, information about the number of sheets to be processed, and a sheet position information.

The sheet kind information is information on the size, thickness, material, and the like of a sheet, and is information set beforehand in the image forming apparatus main body A or information from a sensor provided in each portion, and the sheet kind information is inputted into the control section 9B as an electrical signal.

The control section 9B controls the speed of the motors M1, M2, and M3 based on the sheet kind information.

Further, the initial stop position P0 is made as a fixed position in the above embodiments. However, by changing the setting of the initial stop position P0 in accordance with the size of a sheet, a sheet of different sizes can be coped with.

The information about the number of sheets to be processed is information in connection with the number of sheets to be conveyed out from the image forming apparatus main body A, and is information about the sum number of sheets per one job and information about the order number of a sheet being conveyed, and the information about the number of sheets to be processed is inputted into the control section 9B as an electrical signal.

The control section 9B controls the speed of the motors M1, M2, and M3 based on the information about the number of sheets to be processed.

The sheet position information is information inputted into the control section 9B as an electrical signal from sheet position detecting sensors arranged in the image forming apparatus main body A, an intermediate conveyance unit B and so on.

The control section 9B controls the On-Off actions and speed of the motors M1, M2, and M3 and the On-Off actions of the solenoids SOL3, SOL4, and SOL5 based on the sheet position information.

Next, the timing of operations of the sheet aligning apparatus B1 in the second and third embodiments according to the present invention is explained with reference to FIG. 12.

Figure 12:
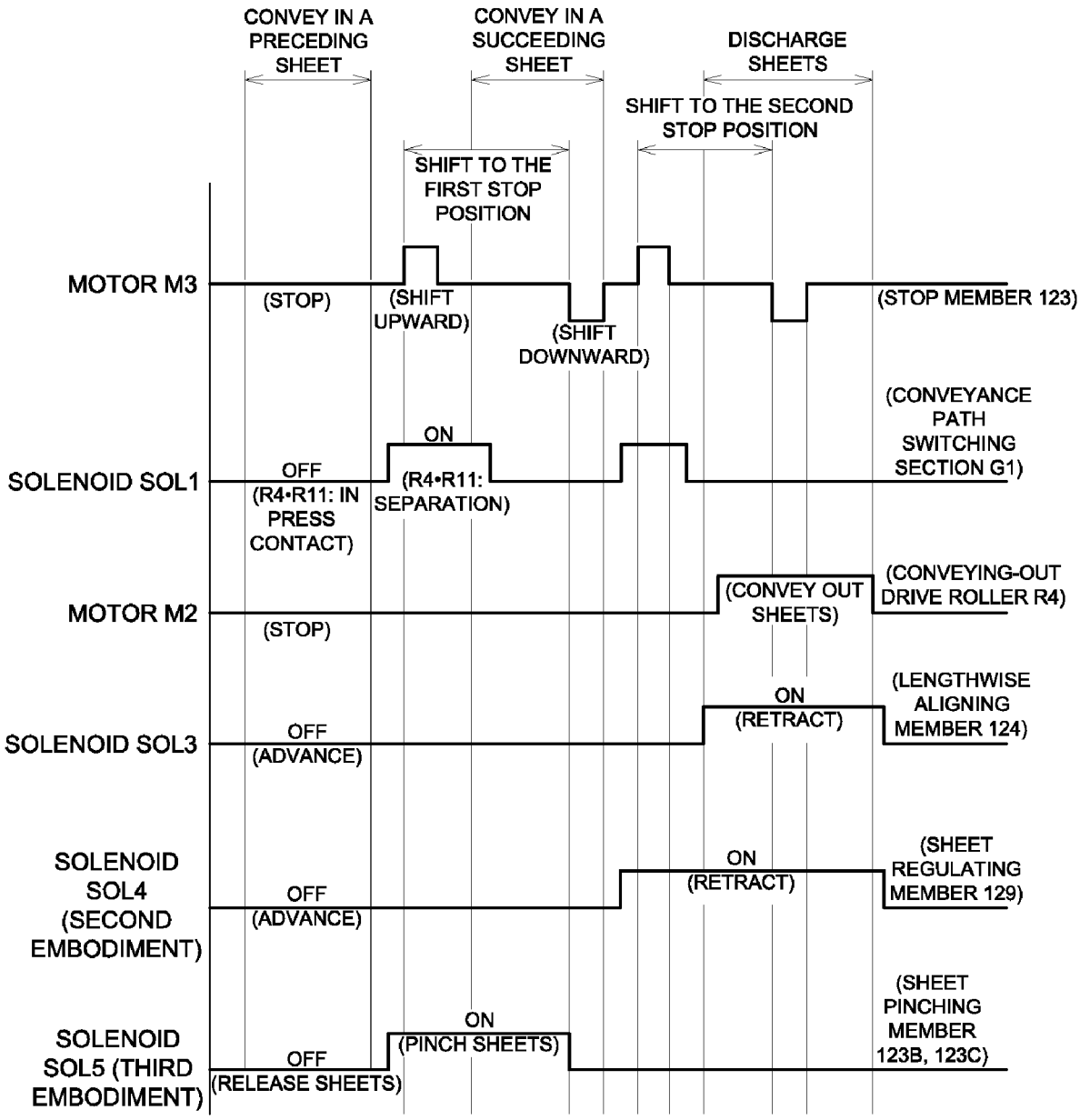
FIG. 12 is a timing chart about the second and third embodiments in the sheet aligning apparatus B1 according to the present invention.

FIG. 12 is a timing chart with regard to the sheet aligning apparatus B1 in the second and third embodiments according to the present invention.

First, the timing of operations of the sheet aligning apparatus B1 in the second embodiment according to the present invention is explained.

In the second embodiment, after the preceding sheet S1 has been conveyed in the sheet shifting section YS, the conveying-out follower roller R11 is released from the pressure contact with the conveying-out drive roller R4 by the solenoid SOL1, whereby the sheet storage conveyance path r12 is opened in the direction toward the sheet conveying-out path.

Then, the motor M3 is driven to shift the stop member 123 in the sheet shifting section YS from the initial stop position P0 to the first stop position P1 and to stop the stop member 123 at the first stop position P1. Thereafter, before the stop member 123 is shifted downward, the solenoid SOL1 is turned off electricity, and in turn the conveying-out drive roller R4 and the conveying-out follower roller R11 are brought into pressure contact with each other again.

When the succeeding sheet S2 is conveyed into the sheet storage conveyance path r12 from the sheet conveying-in conveyance path r11, the motor M3 is driven in connection with this conveyance, the stop member 123 is shifted downward to the initial stop position P0.

The solenoid SOL1 is turned on electricity again, and the conveying-out follower roller R11 is released from pressure contact with the conveying-out drive roller R4.

The solenoid SOL4 used for this embodiment turns on electricity just before or after the turning on electricity for the solenoid SOL1 for the second time, and the sheet regulating member 129 is retracted from the sheet storage conveyance path r12 (refer to FIG. 9).

Then, the stop member 123 is shifted to the second stop position P1 by the driving of the motor M3, and the aligning for the sheets S is conducted. Thereafter, the solenoid SOL1 is turned off electricity again, whereby the conveying-out drive roller R4 and the conveying-out follower roller R11 are brought in contact with each other again so as to pinch the sheets S therebetween.

Subsequently, the lengthwise aligning member 124 is retracted from the sheet storage conveyance path r12 by the solenoid SOL3, and then the conveying-out drive roller R4 is rotated by the motor M2, and the sheets S are conveyed out towards the next process. During the conveying-out of the sheets S, the motor M3 is driven, and the stop member 123 is shifted to the initial stop position P0.

After the sheet is conveyed out from the conveying-out drive roller R4, the motor M2 stop rotation. Then, the solenoid SOL3 and SOL4 are turned off electricity, and the lengthwise aligning member 124 and the sheet regulating member 129 proceed into the sheet storage conveyance path r12 again.

Next, the timing of operations of the sheet aligning apparatus B1 in the third embodiments according to the present invention is explained.

Since the timing of operations of the third embodiment is similar to the timing of operations of the second embodiment, only different points are explained.

The point that the third embodiment differs from the second embodiment is a point that although the operation of solenoid SOL4 in the second embodiment is conducted at the time of shifting the stop member 123 to the second stop position, the operation of the solenoid SOL5 in the third embodiment is conducted at the time of shifting the stop member 123 to the first stop position.

That is, in the third embodiment, the solenoid SOL5 is turned on electricity just before or after the solenoid SOL1 is turned on electricity before the stop member 123 is shifted to the first stop position P1, whereby the sheet pinching members 123B and 123C according to the present invention are actuated so as to pinch the preceding sheet on the sheet shifting section YS.

After the stop member 123 is shifted to the first stop position P1, just before the stop member 123 is shifted to the initial stop position P0 again, the solenoid SOL5 is turned off electricity, whereby the pinching of the preceding sheet S1 by the sheet pinching members 123B and 123C is canceled.

Since the timing of other operations in the third embodiment are the same as that of each section in the second embodiment except the action of the solenoid SOL4 and the sheet regulating member 129, the explanations for them are omitted.

Next, the operations of the sheet aligning apparatus B1 according to the present invention in the first, second and third embodiments are explained with reference to FIGS. 13 to 15.

Figure 13:
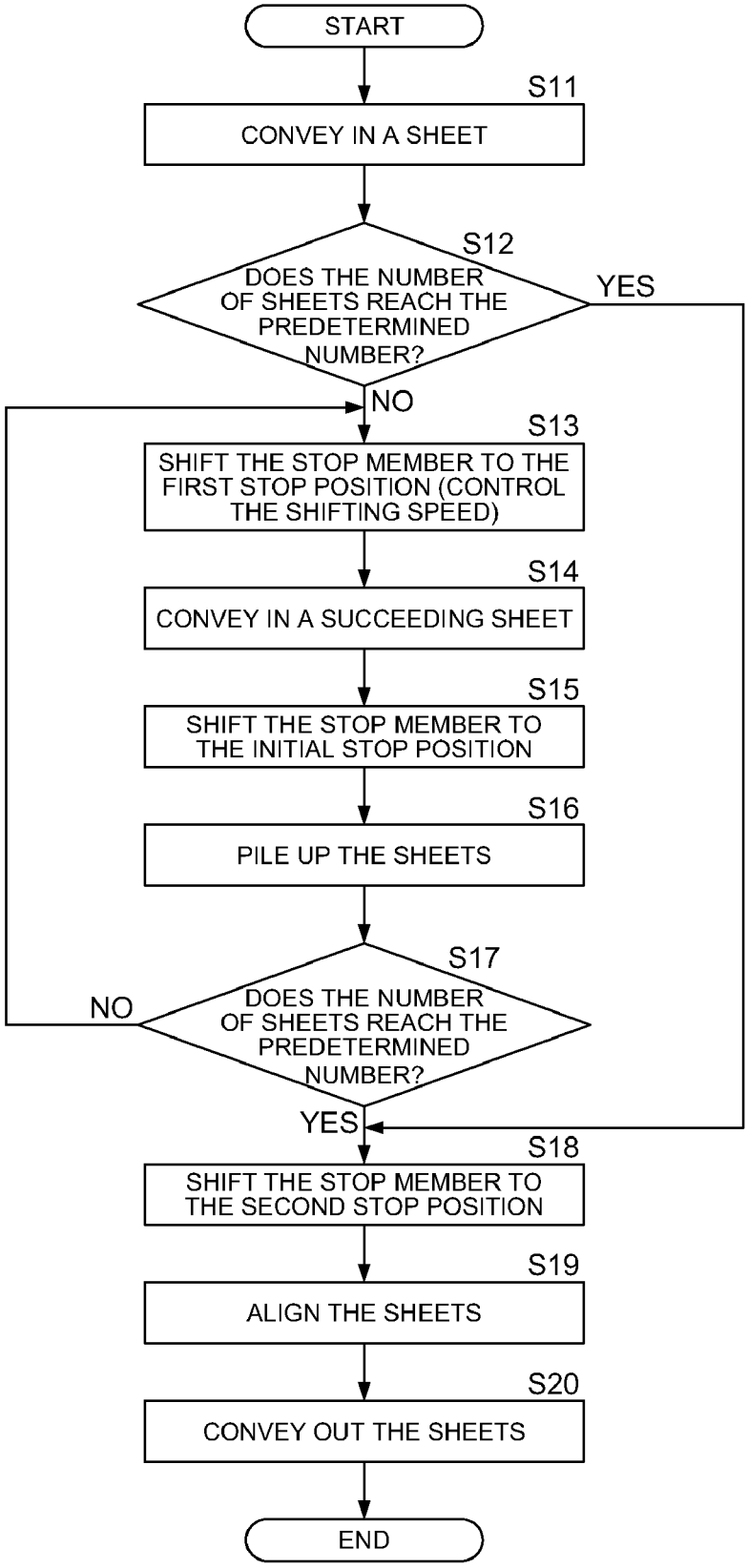
FIG. 13 is a flowchart for explaining the procedures of operations of the first embodiment of in the sheet aligning apparatus B1 to according to the present invention.

FIG. 13 is a flowchart for explaining the operations of the sheet aligning apparatus B1 according to the present invention in the first embodiment.

First, the preceding sheet S1 discharged from the discharging section 5E of the image forming apparatus main body A is conveyed through the sheet conveying-in conveyance path r11 and the sheet storage conveyance path r12 and stored into the sheet shifting section YS of the sheet storage section 12 by the rotation of the conveying-in drive roller R3 (Step S11).

Next, the control section 9B judges based on information about the number of processed sheets from the control section 9A of the image forming apparatus main body A whether or not the number of sheets S1 stored in the sheet shifting section YS reach the predetermined number (Step S12). If the number of sheets does not reach the predetermined number (in Step S12, No), the operation proceeds to Step S13. In contrast, if the number of sheets reaches the predetermined number (in Step S12, Yes), the operation proceeds to Step S18.

In Step S13, the control section 9B controls the rotating speed of the motor M3, changes the shifting speed of the stop member 123, and shifts the stop member 123 from the initial stop position P0 to the first stop position P1 (step S13).

When the stop member 123 is located at the first stop position P1 and the inversed leading end of the preceding sheet S1 in the sheet conveying direction is located in the predetermined region SR, the control section 9B rotates the conveying-in drive roller R3 to convey in the succeeding sheet S2 from the sheet conveying-in conveyance path r11 to the sheet storage conveyance path r12 (Step S14).

In accordance with the conveying-in of the succeeding sheet S2 in the sheet storage conveyance path r12, the control section 9B shifts the stop member 123 from the first stop position P1 to the initial stop position P0 (Step S15).

While the stop member 123 stops at the initial stop position P0, the succeeding sheet S2 is stored in the sheet shifting section YS, and is piled up on the preceding sheet S1 (Step S16).

The control section 9B judges whether or the number of sheets S stored in the sheet shifting section YS reach the predetermined number (step S17), if the number of sheets S reaches the predetermined number (in Step S17, Yes), the operation proceeds to Step S18, and if the number of sheets S does not reach the predetermined number (in step S17, No), the operation returns to Step S13.

If the number of sheets S stored in the sheet shifting section YS does not reach the predetermined number, the operation returns to step S13, and the operations of from Step S13 to Step S17 are repeated.

If the number of sheets S stored in the sheet shifting section YS reaches the predetermined number, the operation proceeds to Step S18, and the control section 9B shifts the stop member 123 from the initial stop position P0 to the second stop position P2. Further, before the stop member 123 reaches the second stop position P2, the solenoid SOL1 is actuated to rock the conveyance path switching member G1 so that the conveying-out follower roller R11 is separated from the conveying-out drive roller R4. Furthermore, the solenoid SOL3 is actuated to make the lengthwise aligning member 124 proceed into the sheet storage conveyance path r12 (Step S18).

When the stop member 123 reaches the second stop position P2, the inversed leading end in the sheet conveying-out direction of the sheets S stored in the sheet shifting section YS come in contact with the lengthwise aligning member 124, whereby the aligning of the sheets S in the conveying direction is performed. Furthermore, the motor M4 is driven to actuate the widthwise aligning section 122, whereby the aligning of the sheets S in the sheet width direction is performed (Step S19).

When the aligning of sheets S has completed, the conveyance path switching member G1 is made to rock so that the conveying-out follower roller R11 is brought in pressure contact with the conveying-out drive roller R4 so as to pinch the aligned sheets S therebetween. Subsequently, the motor M2 is driven to rotate the conveying-out drive roller R4 so that the sheets S are conveyed out toward the next step (Step S20).

Figure 14:
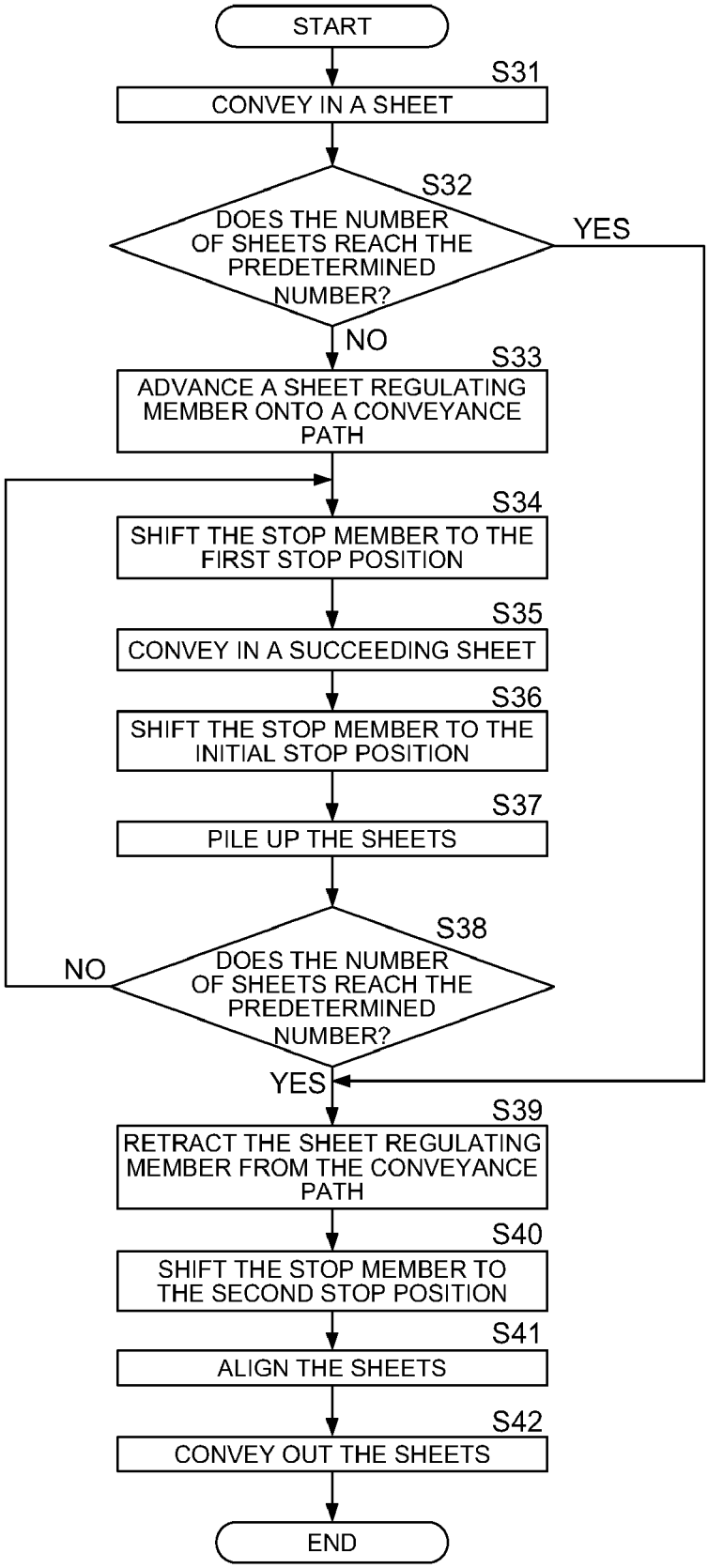
FIG. 14 is a flowchart for explaining the procedures of operations of the second embodiment of in the sheet aligning apparatus B1 to according to the present invention.

FIG. 14 is a flowchart for explaining the procedure of operations of the sheet aligning apparatus B1 in the second embodiment according to the present invention.

First, the preceding sheet S1 discharged from the discharging section 5E of the image forming apparatus main body A is conveyed through the sheet conveying-in conveyance path r11 and the sheet storage conveyance path r12 and stored into the sheet shifting section YS of the sheet storage section 12 by the rotation of the conveying-in drive roller R3 (Step S31).

Next, the control section 9B judges based on information about the number of processed sheets from the control section 9A of the image forming apparatus main body A whether or not the number of sheets S1 stored in the sheet shifting section YS reach the predetermined number (Step S32). If the number of sheets does not reach the predetermined number (in Step S32, No), the operation proceeds to Step S33. In contrast, if the number of sheets reaches the predetermined number (in Step S32, Yes), the operation proceeds to Step S39.

In Step S33, the control section 9B operates the solenoid SOL4 such that the sheet regulating member 129 advances into the sheet storage conveyance path r12 (Step S33).

Subsequently, the control section 9B drives the motor M3 to shift the stop member 123 from the initial stop position P0 to the first stop position P1 (step S34).

When the stop member 123 is located at the first stop position P1 and the inversed leading end of the preceding sheet S1 in the sheet conveying direction is located in the predetermined region SR, the control section 9B rotates the conveying-in drive roller R3 to convey the succeeding sheet S2 from the sheet conveying-in conveyance path r11 into the sheet storage conveyance path r12 (Step S35).

In accordance with the conveying-in of the succeeding sheet S2 in the sheet storage conveyance path r12, the control section 9B shifts the stop member 123 from the first stop position P1 to the initial stop position P0 (Step S36).

While the stop member 123 stops at the initial stop position P0, the succeeding sheet S2 is stored in the sheet shifting section YS, and is piled up on the preceding sheet S1 (Step S37).

The control section 9B judges whether or the number of sheets S stored in the sheet shifting section YS reach the predetermined number (step S38), if the number of sheets S reaches the predetermined number (in Step S38, Yes), the operation proceeds to Step S39, and if the number of sheets S does not reach the predetermined number (in step S38, No), the operation returns to Step S34.

If the number of sheets S stored in the sheet shifting section YS does not reach the predetermined number, the operation returns to step S34, and the operations of from Step S34 to Step S38 are repeated.

If the number of sheets S stored in the sheet shifting section YS reaches the predetermined number, the operation proceeds to Step S39, and the control section 9B actuates the solenoid SOL4 to retract the sheet regulating member 129 from the sheet storage conveyance path r12 (Step S39).

Subsequently, the control section 9B shifts the stop member 123 from the initial stop position P0 to the second stop position P2. Further, before the stop member 123 reaches the second stop position P2, the solenoid SOL1 is actuated to rock the conveyance path switching member G1 so that the conveying-out follower roller R11 is separated from the conveying-out drive roller R4. Furthermore, the solenoid SOL3 is actuated to make the lengthwise aligning member 124 to proceed into the sheet storage conveyance path r12 (Step S40).

When the stop member 123 reaches the second stop position P2, the inversed leading end in the sheet conveying-out direction of the sheets S stored in the sheet shifting section YS come in contact with the lengthwise aligning member 124, whereby the aligning of the sheets S in the conveying direction is performed. Furthermore, the motor M4 is driven to actuate the widthwise aligning section 122, whereby the aligning of the sheets S in the sheet width direction is performed (Step S41).

When the aligning of sheets S has completed, the conveyance path switching member G1 is made to rock so that the conveying-out follower roller R11 is brought in pressure contact with the conveying-out drive roller R4 so as to pinch the aligned sheets S therebetween. Subsequently, the motor M2 is driven to rotate the conveying-out drive roller R4 so that the sheets S are conveyed out toward the next step (Step S42).

Figure 15:
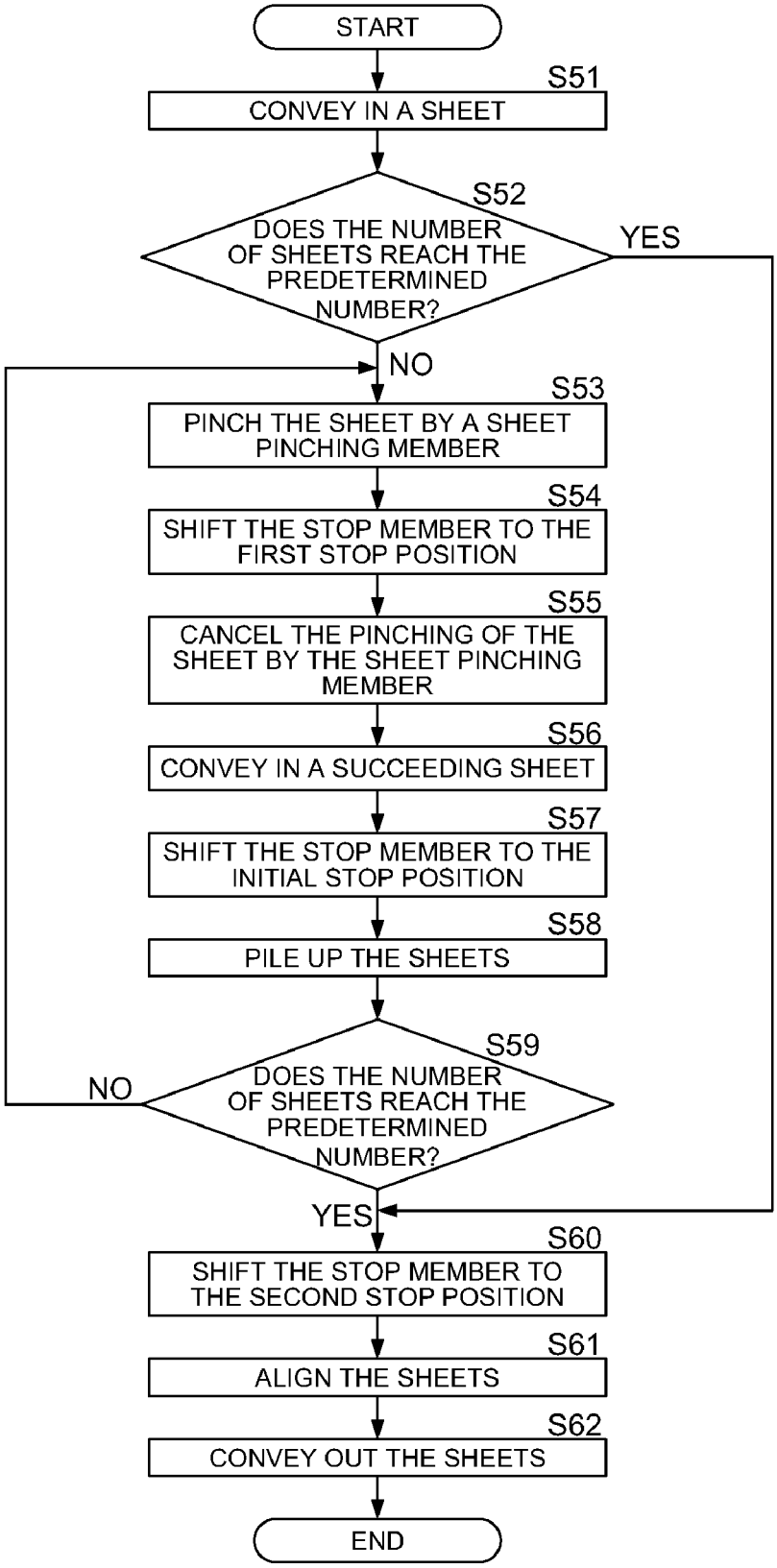
FIG. 15 is a flowchart for explaining the procedures of operations of the third embodiment of in the sheet aligning apparatus B1 to according to the present invention.

FIG. 15 is a flowchart for explaining the procedure of operations of the sheet aligning apparatus B1 in the third embodiment according to the present invention.

First, the preceding sheet S1 discharged from the discharging section 5E of the image forming apparatus main body A is conveyed through the sheet conveying-in conveyance path r11 and the sheet storage conveyance path r12 and stored into the sheet shifting section YS of the sheet storage section 12 by the rotation of the conveying-in drive roller R3 (Step S51).

Next, the control section 9B judges based on information about the number of processed sheets from the control section 9A of the image forming apparatus main body A whether or not the number of sheets S1 stored in the sheet shifting section YS reach the predetermined number (Step S52). If the number of sheets does not reach the predetermined number (in Step S52, No), the operation proceeds to Step S53. In contrast, if the number of sheets reaches the predetermined number (in Step S52, Yes), the operation proceeds to Step S60.

In Step S53, the control section 9B operates the solenoid SOL5 to actuate the sheet pinching member 123B and 123 to pinch the neighborhood of the inversed back end of the sheet in the sheet conveying-out direction (Step S53).

Subsequently, the control section 9B drives the motor M3 to shift the stop member 123 from the initial stop position P0 to the first stop position P1 (step S54).

The control section 9B operates again the solenoid SOL5 to actuate the sheet pinching member 123B and 123 to cancel the pinching of the sheet (Step S56).

When the stop member 123 is located at the first stop position P1 and the inversed leading end of the preceding sheet S1 in the sheet conveying direction is located in the predetermined region SR, the control section 9B rotates the conveying-in drive roller R3 to convey the succeeding sheet S2 from the sheet conveying-in conveyance path r11 into the sheet storage conveyance path r12 (Step S56).

In accordance with the conveying-in of the succeeding sheet S2 in the sheet storage conveyance path r12, the control section 9B shifts the stop member 123 from the first stop position P1 to the initial stop position P0 (Step S57).

While the stop member 123 stops at the initial stop position P0, the succeeding sheet S2 is stored in the sheet shifting section YS, and is piled up on the preceding sheet S1 (Step S58).

The control section 9B judges whether or the number of sheets S stored in the sheet shifting section YS reach the predetermined number (step S59), if the number of sheets S reaches the predetermined number (in Step S59, Yes), the operation proceeds to Step S60, and if the number of sheets S does not reach the predetermined number (in step S59, No), the operation returns to Step S53.

If the number of sheets S stored in the sheet shifting section YS does not reach the predetermined number, the operation returns to step S53, and the operations of from Step S53 to Step S59 are repeated.

If the number of sheets S stored in the sheet shifting section YS reaches the predetermined number, the operation proceeds to Step S60, and the control section 9B shifts the stop member 123 from the initial stop position P0 to the second stop position P2. Further, before the stop member 123 reaches the second stop position P2, the solenoid SOL1 is actuated to rock the conveyance path switching member G1 so that the conveying-out follower roller R11 is separated from the conveying-out drive roller R4. Furthermore, the solenoid SOL3 is actuated to make the lengthwise aligning member 124 to proceed into the sheet storage conveyance path r12 (Step S60).

When the stop member 123 reaches the second stop position P2, the inversed leading end in the sheet conveying-out direction of the sheets S stored in the sheet shifting section YS come in contact with the lengthwise aligning member 124, whereby the aligning of the sheets S in the conveying direction is performed. Furthermore, the motor M4 is driven to actuate the widthwise aligning section 122, whereby the aligning of the sheets S in the sheet width direction is performed (Step S61).

When the aligning of sheets S has completed, the conveyance path switching member G1 is made to rock so that the conveying-out follower roller R11 is brought in pressure contact with the conveying-out drive roller R4 so as to pinch the aligned sheets S therebetween. Subsequently, the motor M2 is driven to rotate the conveying-out drive roller R4 so that the sheets S are conveyed out toward the next step (Step S62).

Here, in order to perform the lengthwise aligning more exactly, when the stop member 123 stops at the second stop position P2, the above embodiments are structured such that the lengthwise aligning is performed by pinching the sheets between the stop member 123 and the lengthwise aligning member 124. However, the lengthwise aligning may performed without the lengthwise aligning member 124. That is, the lengthwise aligning is performed by bringing sheets in contact with a stop member without providing the lengthwise aligning member 124. The structure in which the lengthwise aligning member 124 is not provided is the same structure shown in FIG. 2 except the lengthwise aligning member 124 and the solenoid SOL3, and since other structure and operations are the same as that of the first, second and third embodiments, the explanation for them are omitted.

As describe above, the object of the present invention is attained by the sheet aligning apparatus and the image forming system employing the following preferable structures.

1. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path;

a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

a sheet conveying-out section provided at a downstream side from the meeting point in the sheet conveying-out direction and to convey out sheets from the sheet storage conveyance path; and a lengthwise aligning member provided at a downstream side from the sheet conveying-out section in the sheet conveying-out direction and to align sheets in the sheet conveying direction by coming in contact with the inversed leading end in the sheet conveying-out direction of the sheets shifted with the shifting of the stop member toward the second stop position;

wherein the stop member shifting section controls the shifting speed at the time of shifting the stop member from the initial stop position to the first stop position in such a way that the inversed leading end in the conveying-out direction of the sheets is prevented from reaching the sheet conveying-out section due to inertia of the sheets right after the stop member have been shifted and stopped at the first stop position.

2. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path;

a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

a sheet conveying-out section provided at a downstream side from the meeting point in the sheet conveying-out direction and to convey out sheets from the sheet storage conveyance path;

a lengthwise aligning member provided at a downstream side from the sheet conveying-out section in the sheet conveying-out direction and to align sheets in the sheet conveying direction by coming in contact with the inversed leading end in the sheet conveying-out direction of the sheets shifted with the shifting of the stop member toward the second stop position;

a sheet regulating member provided between the sheet conveying-out section and the meeting point and to regulate the inversed leading end in the conveying-out direction of the sheets from reaching the sheet conveying-out section due to inertia of the sheets right after the stop member have been shifted and stopped at the first stop position; and a sheet regulating member driving section to make the sheet regulating member advance into or retract from the sheet storage conveyance path;

wherein the sheet regulating member driving section is controlled in such a way that when the stop member shifting section shifts the stop member from the initial stop position to the first stop position, the sheet regulating member driving section makes the sheet regulating member advance into the sheet storage conveyance path before the stop member is shifted to the first stop position, and when the stop member shifting section shifts the stop member from the initial stop position to the second stop position, the sheet regulating member driving section makes the sheet regulating member retract from the sheet storage conveyance path before the stop member is shifted to the second stop position.

3. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path;

a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

a sheet conveying-out section provided at a downstream side from the meeting point in the sheet conveying-out direction and to convey out sheets from the sheet storage conveyance path;

a lengthwise aligning member provided at a downstream side from the sheet conveying-out section in the sheet conveying-out direction and to align sheets in the sheet conveying direction by coming in contact with the inversed leading end in the sheet conveying-out direction of the sheets shifted with the shifting of the stop member toward the second stop position;

a sheet pinching member arranged in the vicinity of the stop surface of the bumping stop surface of the stop member and capable of coming in contact with or separating from the sheet in the sheet storage conveyance path so as to pinch the sheet from both sides of the sheets in the thickness direction; and a sheet pinching member driving section to make the sheet pinching member take a pinching position to come in contact with the sheet or a pinching releasing position to separate from the sheet;

wherein the sheet pinching member driving section is controlled in such a way that when the stop member shifting section shifts the stop member from the initial stop position to the first stop position, the sheet pinching member driving section makes the sheet pinching member take the pinching position before the stop member is shifted to the first stop position, and when the stop member shifting section shifts the stop member from the initial stop position to the second stop position, the sheet pinching member driving section makes the sheet pinching member take the pinching releasing position before the stop member is shifted to the second stop position.

4. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a sheet conveying-out section provided at a downstream side from the meeting point in the sheet conveying-out direction and to convey out sheets from the sheet storage conveyance path;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path; and a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

wherein the stop member shifting section controls the shifting speed at the time of shifting the stop member from the initial stop position to the first stop position in such a way that the inversed leading end in the conveying-out direction of the sheets is prevented from reaching the sheet conveying-out section due to inertia of the sheets right after the stop member have been shifted and stopped at the first stop position.

5. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a sheet conveying-out section provided at a downstream side from the meeting point in the sheet conveying-out direction and to convey out sheets from the sheet storage conveyance path;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path;

a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

a sheet regulating member provided between the sheet conveying-out section and the meeting point and to regulate the inversed leading end in the conveying-out direction of the sheets from reaching the sheet conveying-out section due to inertia of the sheets right after the stop member have been shifted and stopped at the first stop position; and a sheet regulating member driving section to make the sheet regulating member advance into or retract from the sheet storage conveyance path;

wherein the sheet regulating member driving section is controlled in such a way that when the stop member shifting section shifts the stop member from the initial stop position to the first stop position, the sheet regulating member driving section makes the sheet regulating member advance into the sheet storage conveyance path before the stop member is shifted to the first stop position, and when the stop member shifting section shifts the stop member from the initial stop position to the second stop position, the sheet regulating member driving section makes the sheet regulating member retract from the sheet storage conveyance path before the stop member is shifted to the second stop position.

6. A sheet aligning apparatus comprises:

a sheet storage conveyance path to convey in or convey out sheets;

a sheet conveying-in conveyance path having a meeting point with the sheet storage conveyance path at a downstream side in a sheet conveying-in direction and to convey in sheets toward the meeting point;

a sheet conveying-in section provided at an upstream side in the sheet conveying-in direction on the sheet conveying-in conveyance path from the meeting point and to convey in sheets toward the meeting point;

a sheet conveying-out section provided at a downstream side from the meeting point in the sheet conveying-out direction and to convey out sheets from the sheet storage conveyance path;

a stop member having a bumping stop surface to stop sheets conveyed into the sheet storage conveyance path by coming in contact with the leading end of the sheets in a sheet conveying-in direction and capable of shifting along the sheet storage conveyance path;

a sheet storing section constituted by the sheet storage conveyance path and the stop member and to store sheets conveyed into the sheet storage conveyance path;

a stop member shifting section to shift the stop member from an initial stop position to wait at the time of storing sheets to a first stop position to prevent interruption of succeeding sheets, or to a second stop position to align plural sheets stored in the sheet storing section in a sheet conveying direction;

a sheet pinching member arranged in the vicinity of the stop surface of the bumping stop surface of the stop member and capable of coming in contact with or separating from the sheet in the sheet storage conveyance path so as to pinch the sheet from both sides of the sheets in the thickness direction; and a sheet pinching member driving section to make the sheet pinching member take a pinching position to come in contact with the sheet or a pinching releasing position to separate from the sheet;

wherein the sheet pinching member driving section is controlled in such a way that when the stop member shifting section shifts the stop member from the initial stop position to the first stop position, the sheet pinching member driving section makes the sheet pinching member take the pinching position before the stop member is shifted to the first stop position, and when the stop member shifting section shifts the stop member from the initial stop position to the second stop position, the sheet pinching member driving section makes the sheet pinching member take the pinching releasing position before the stop member is shifted to the second stop position.

7. An image forming system, comprises:

an image forming section to form an image on a sheet, the sheet aligning apparatus described in any one of above 1 to 6, provided downstream side of the image forming apparatus in the sheet conveying direction and to receive the sheet on which an image is formed by the image forming apparatus, and a post processing apparatus provided downstream side of the sheet aligning apparatus and to conduct a post processing for the sheets discharged from the sheet aligning apparatus.

According to the structure of the present invention, when the stop member is shifted from the initial stop position to the first stop position in order to avoid the interference among sheets, it is possible to prevent a sheet from proceeding excessively due to the inertia of the sheet, whereby it is possible to provide a sheet aligning apparatus and a image forming system in which there is no problems, such as a sheet conveyance failure and a sheet alignment failure.

What is claimed is:

1. A sheet aligning apparatus, comprising:

a sheet storing section having an open end portion through which a sheet is conveyed in or out;

a conveying-in section having a conveying-in path to covey a sheet into the open end portion of the sheet storing section;

a conveying-out section having a conveying-out path to covey out a sheet from the open end portion of the sheet storing section, wherein the conveying-in path and the conveying-out form a meeting point at the open end portion;

a stop member arranged in the sheet storing section so as to oppose the open end portion;

a shifting section to shift the stop member from an initial position to a first position, wherein when the stop member is positioned at the initial position, the stop member comes in contact with the leading end of a preceding sheet conveyed into the sheet storing section through the open end portion, and when the shifting section shifts the stop member from the initial position to the first position, the preceding sheet is shifted inversely together with the stop member and the back end of the preceding sheet proceeds as the inversed leading end from the meeting point to the conveying-out path so that a succeeding sheet is allowed to be conveyed from the conveying-in path into the open end portion; and a control section to control the conveying-in section and the conveying-out section so as to convey a sheet at a sheet conveying speed, and to control the shifting section so as to shift the stop member at a shifting speed, wherein when the shifting section shifts the stop member from the initial position to the first position, the control section controls the shifting speed of the stop member to be slower than the sheet conveying speed, so that the back end of the preceding sheet is prevented from proceeding more than a predetermined distance due to the inertia of the shift.

2. The sheet aligning apparatus described in claim 1, wherein when the succeeding sheet is conveyed from the conveying-in path into the open end portion, the shifting section shifts the stop member from the first position to the initial position so that the stop member comes in contact with a leading end of the succeeding sheet and the succeeding sheet is piled up on the preceding sheet.

3. The sheet aligning apparatus described in claim 2, further comprising a lengthwise aligning section to align back ends of the preceding and succeeding sheets when the shifting section shifts the stop member from the initial position to a second position.

4. The sheet aligning apparatus described in claim 1, wherein the shift regulating section is a shift regulating member to come in contact with the back end of the preceding sheet on the conveying-out path when the shifting section shifts the stop member from the initial position to the first position.

5. The sheet aligning apparatus described in claim 4, wherein the shift regulating member advances onto or retracts from the conveying-out path in accordance with the shift of the stop member.

6. The sheet aligning apparatus described in claim 1, wherein the shift regulating section is a pair of pinching members to pinch the preceding sheet widthwise therebetween when the shifting section shifts the stop member from the initial position to the first position.

7. The sheet aligning apparatus described in claim 6, wherein the pair of pinching members pinches the preceding sheet widthwise in accordance with the shift of the stop member.

8. The sheet aligning apparatus described in claim 1, wherein the control section controls the shifting speed of the stop member to be slower than the sheet conveying speed, so that the back end of the preceding sheet is prevented from entering the conveying-out section due to the inertia of the shift.

9. The sheet aligning apparatus described in claim 1, wherein when the shifting section shifts the stop member from the initial position to the second position so as to shift the preceding sheet and the succeeding sheet to the conveying-out section, the control section controls the shifting speed of the stop member to be equal to the sheet conveying speed.

* * * * *